US010362920B2

(12) United States Patent
Moser et al.

(10) Patent No.: US 10,362,920 B2
(45) Date of Patent: Jul. 30, 2019

(54) SURFACE CLEANING MACHINE

(71) Applicant: Alfred Kärcher GmbH & Co. KG, Winnenden (DE)

(72) Inventors: Fabian Moser, Schorndorf (DE); Saulius Martinkenas, Schwaikheim (DE); Johanna Buchmann, Stuttgart (DE); Andreas Mueller, Oppenweiler (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 106 days.

(21) Appl. No.: 15/485,992

(22) Filed: Apr. 12, 2017

(65) Prior Publication Data

US 2017/0215677 A1 Aug. 3, 2017

Related U.S. Application Data

(63) Continuation of application No. PCT/EP2015/073478, filed on Oct. 9, 2015.

(30) Foreign Application Priority Data

Oct. 13, 2014 (DE) ..... 10 2014 114 776

(51) Int. Cl.
*A47L 11/24* (2006.01)
*A47L 11/30* (2006.01)
(Continued)

(52) U.S. Cl.
CPC ..... *A47L 11/4041* (2013.01); *A47L 9/0411* (2013.01); *A47L 11/202* (2013.01);
(Continued)

(58) Field of Classification Search
CPC ..... A47L 11/4041; A47L 11/4044; A47L 11/302; A47L 11/4083; A47L 11/4027;
(Continued)

(56) References Cited

U.S. PATENT DOCUMENTS 1,436,420 A 11/1922 Weydell
4,136,420 A 1/1979 Cyphert et al.
(Continued)

FOREIGN PATENT DOCUMENTS

CA 2 411 936 11/2003
CH 607 578 9/1978
(Continued)

*Primary Examiner* — David Redding
(74) *Attorney, Agent, or Firm* — Womble Bond Dickinson (US) LLP

(57) ABSTRACT

A surface cleaning machine is provided, including a cleaning roller holder, at least one cleaning roller which is arranged on the cleaning roller holder, a drive device for driving the at least one cleaning roller in rotation, and a sweeping element which is associated with the at least one cleaning roller and which feeds swept material to the at least one cleaning roller, wherein the sweeping element, at least during a cleaning operation, projects with a front region into a jacket of the at least one cleaning roller, wherein a front face end of the sweeping element is arranged on the front region.

25 Claims, 14 Drawing Sheets

(51) Int. Cl.
*A47L 11/40* (2006.01)
*A47L 11/202* (2006.01)
*A47L 9/04* (2006.01)

(52) U.S. Cl.
CPC ..... *A47L 11/24* (2013.01); *A47L 11/302* (2013.01); *A47L 11/4008* (2013.01); *A47L 11/4016* (2013.01); *A47L 11/4027* (2013.01); *A47L 11/4044* (2013.01); *A47L 11/4069* (2013.01); *A47L 11/4075* (2013.01); *A47L 11/4083* (2013.01); *A47L 11/4088* (2013.01)

(58) Field of Classification Search
CPC ..... A47L 11/4008; A47L 11/4069; A47L 11/4075; A47L 11/4088; A47L 11/4016; A47L 9/0411; A47L 11/202; A47L 11/24; A47L 11/40
See application file for complete search history.

(56) References Cited

U.S. PATENT DOCUMENTS

| | | | |
|---|---|---|---|
| 4,173,054 | A | 11/1979 | Ando |
| 4,668,256 | A | 5/1987 | Billiet et al. |
| 5,086,539 | A | 2/1992 | Rench |
| 5,350,432 | A | 9/1994 | Lee |
| 5,657,504 | A | 8/1997 | Khoury |
| 6,026,529 | A | 2/2000 | Caruso |
| 6,400,048 | B1 | 6/2002 | Nishimura et al. |
| 6,475,256 | B2 | 11/2002 | Matsubara et al. |
| 6,662,402 | B2 | 12/2003 | Giddings et al. |
| 6,735,812 | B2 | 5/2004 | Hekman et al. |
| 7,128,770 | B2 | 10/2006 | Oh et al. |
| 7,150,068 | B1 | 12/2006 | Ragner |
| 7,272,870 | B2 | 9/2007 | Pierce et al. |
| 7,341,611 | B2 | 3/2008 | Greene et al. |
| 7,559,963 | B2 | 7/2009 | Oh et al. |
| 7,665,174 | B2 | 2/2010 | Basham et al. |
| 7,921,497 | B2 | 4/2011 | Cook et al. |
| 7,967,914 | B2 | 6/2011 | Giddings et al. |
| 7,979,952 | B2 * | 7/2011 | Beskow ..... A47L 9/04 15/322 |
| 8,016,996 | B2 | 9/2011 | Field et al. |
| 8,025,786 | B2 | 9/2011 | Field et al. |
| 8,230,549 | B2 | 7/2012 | Lenkiewicz et al. |
| 9,289,105 | B2 | 3/2016 | Moes |
| 9,999,332 | B2 * | 6/2018 | Braendle ..... A47L 11/204 |
| 2002/0194692 | A1 | 12/2002 | Giddings et al. |
| 2003/0159232 | A1 | 8/2003 | Hekman et al. |
| 2005/0160553 | A1 | 7/2005 | Gregory |
| 2005/0262659 | A1 | 12/2005 | Roschi et al. |
| 2009/0089967 | A1 | 4/2009 | Yang et al. |
| 2009/0119871 | A1 | 5/2009 | Dilger et al. |
| 2010/0132150 | A1 | 6/2010 | Egler et al. |
| 2010/0236010 | A1 | 9/2010 | Johnson |
| 2012/0066861 | A1 | 3/2012 | Louis et al. |
| 2012/0222244 | A1 | 9/2012 | Conrad |
| 2013/0091663 | A1 | 4/2013 | Mersmann |
| 2013/0219641 | A1 | 8/2013 | Guijarro |
| 2014/0000060 | A1 | 1/2014 | Demirtas et al. |
| 2014/0150984 | A1 | 6/2014 | Nishikawa et al. |
| 2014/0182079 | A1 | 7/2014 | Van Der Kooi et al. |
| 2015/0082579 | A1 * | 3/2015 | Lin ..... A47L 11/4044 15/320 |
| 2016/0270613 | A1 | 9/2016 | Demirtas et al. |
| 2016/0278597 | A1 | 9/2016 | Braendle et al. |
| 2017/0215676 | A1 | 8/2017 | Moser et al. |
| 2017/0215678 | A1 | 8/2017 | Moser et al. |
| 2017/0215679 | A1 | 8/2017 | Moser et al. |
| 2017/0215681 | A1 | 8/2017 | Moser et al. |
| 2018/0228331 | A1 | 8/2018 | Moser et al. |

FOREIGN PATENT DOCUMENTS

| | | | |
|---|---|---|---|
| CN | 2109165 | | 7/1992 |
| CN | 2174947 | | 8/1994 |
| CN | 2266377 | | 11/1997 |
| CN | 2675734 | | 2/2005 |
| CN | 1718149 | | 1/2006 |
| CN | 2845698 | Y | 12/2006 |
| CN | 201158807 | | 12/2008 |
| CN | 201384462 | | 1/2010 |
| CN | 201930938 | | 8/2011 |
| CN | 202151938 | | 2/2012 |
| CN | 102493381 | | 6/2012 |
| CN | 202313126 | | 7/2012 |
| CN | 203346836 | | 12/2013 |
| CN | 103690112 | | 4/2014 |
| DE | 294 642 | | 10/1991 |
| DE | 41 17 957 | | 12/1992 |
| DE | 102 42 257 | | 4/2003 |
| DE | 10 2004 013 262 | | 9/2005 |
| DE | 10 2007 031 371 | | 1/2009 |
| DE | 10 2008 013 485 | | 11/2009 |
| EP | 0 012 337 | | 6/1980 |
| EP | 0 186 005 | | 7/1986 |
| EP | 0 844 843 | | 7/2002 |
| EP | 1 535 560 | | 1/2005 |
| EP | 1 465 518 | | 4/2005 |
| EP | 1 736 089 | | 12/2006 |
| EP | 1994868 | | 11/2008 |
| EP | 2 177 128 | | 4/2010 |
| EP | 2 387 932 | | 11/2011 |
| EP | 2 641 524 | | 9/2013 |
| EP | 2 721 988 | | 4/2014 |
| FR | 2 797 895 | | 3/2001 |
| GB | 1123052 | | 8/1968 |
| GB | 2 341 124 | | 3/2000 |
| GB | 2 411 823 | | 9/2005 |
| GB | 2 420 967 | | 6/2006 |
| GB | 2 435 820 | | 9/2007 |
| JP | 2000342495 | | 12/2000 |
| JP | 2001037695 | | 2/2001 |
| JP | 2005-211350 | | 8/2005 |
| JP | 2013081829 | | 5/2013 |
| WO | WO 84/04663 | | 12/1984 |
| WO | WO90/14787 | * | 12/1990 |
| WO | WO96/39913 | * | 12/1996 |
| WO | WO 97/06721 | | 2/1997 |
| WO | WO 00/78198 | | 12/2000 |
| WO | WO01/037716 | * | 5/2001 |
| WO | WO 02/28251 | | 4/2002 |
| WO | WO 02/069775 | | 9/2002 |
| WO | WO 2005/089614 | | 9/2005 |
| WO | WO 2005/096907 | | 10/2005 |
| WO | WO 2006/102147 | | 9/2006 |
| WO | WO 2006/110459 | | 10/2006 |
| WO | WO 2010/041185 | | 4/2010 |
| WO | WO 2010/140967 | | 12/2010 |
| WO | WO 2013/027140 | | 2/2013 |
| WO | WO 2013/027164 | | 2/2013 |
| WO | WO 2013/106762 | | 7/2013 |

* cited by examiner

SURFACE CLEANING MACHINE

CROSS-REFERENCE TO RELATED APPLICATIONS

This application is a continuation of international application number PCT/EP2015/073478 filed on Oct. 9, 2015 and claims the benefit of German application number 10 2014 114 776.6 filed on Oct. 13, 2014, which are incorporated herein by reference in their entirety and for all purposes.

BACKGROUND OF THE INVENTION

The invention relates to a surface cleaning machine, comprising a cleaning roller holder, at least one cleaning roller which is arranged on the cleaning roller holder, a drive device for driving the at least one cleaning roller in rotation, and a sweeping element, which is associated with the at least one cleaning roller and which feeds swept material to the cleaning roller.

WO 2013/027140 A1 has disclosed a cleaning apparatus for cleaning a surface, which cleaning apparatus has a rotatable brush. A rubber wiper element is also provided which is spaced apart from the brush and which is fastened to an underside of a nozzle housing.

WO 2013/027164 A1 has likewise disclosed a cleaning apparatus with a rotatable brush and with a single rubber wiper element.

EP 2 177 128 A1 has disclosed an apparatus for distributing fluid on a brush.

DE 41 17 157 A1 has disclosed a method for cleaning or swabbing a preferably smooth surface, in which method the surface for cleaning is wiped by means of a substantially cloth-like wiping element, with the wiping element taking up the dirt, and then the dirty wiping element is moistened and thereafter the dirt is removed from the wiping element by suction.

WO 2010/140967 A1 has disclosed a method for cleaning a dirty surface.

CH 607 578 has disclosed a brush apparatus which is connectable to a water line.

EP 0 186 005 A1 has disclosed a brush suction mouth piece equipped with running wheels.

FR 2 797 895 has disclosed a brush.

US 2002/0194692 A1 has disclosed a method for mechanically removing dirt from a surface.

SUMMARY OF THE INVENTION

In accordance with the present invention, a surface cleaning machine is provided, by means of which optimum cleaning results on a surface for cleaning, and in particular on a hard surface for cleaning, are achieved.

In accordance with an embodiment of the invention, the sweeping element, at least during a cleaning operation, projects with a front region into a jacket of the at least one cleaning roller, wherein a front face end of the sweeping element is arranged on the front region.

Then, during cleaning operation, the front face end of the sweeping element projects into the jacket of the at least one cleaning roller.

Coarse dirt is fed to the at least one cleaning roller by means of the sweeping element. Said coarse dirt is then entrained by the at least one cleaning roller and can be removed by suction via at least one suction mouth. Through the provision of a sweeping element which projects with a front region into the jacket of the at least one cleaning roller, a continuous adaptation of the sweeping element to a surface for cleaning is possible. It is thereby ensured that a sweeping edge (as a contact line of the sweeping element against the surface for cleaning) can form during cleaning operation in order to be able to feed coarse dirt to the at least one cleaning roller.

Owing to the fact that the sweeping element penetrates with its front region into the jacket of the at least one cleaning roller, a pile depth of the jacket is, in effect, actively utilized to permit a continuous adaptation to the surface for cleaning.

In particular, it can be achieved in this way that, regardless of an angular position of the surface cleaning machine relative to the surface for cleaning, an at least approximately uniform spacing between the sweeping edge, by means of which the sweeping element lies against the surface for cleaning, and the at least one cleaning roller is achieved in order to be able to sweep up coarse dirt.

In particular, the front region is of elastic form such that, when the surface cleaning machine is set down on a surface for cleaning by means of the at least one cleaning roller, the inherent weight of the surface cleaning machine causes said front region to penetrate into the jacket. The weight force of the surface cleaning machine causes an elastic deformation (in particular bending) at the sweeping element, and thus causes the latter to penetrate into the jacket. In this way, a reliable penetrating action can be realized, wherein a penetrating action can also be ensured in the event of a variation of an angle of the surface cleaning machine relative to the surface for cleaning. No additional device has to be provided for realizing a bias; the inherent weight of the surface cleaning machine ensures the corresponding "bias" during cleaning operation.

In particular, at least during cleaning operation of the surface cleaning machine, the front face end projects in with a spacing to an outer side of the jacket in a range between 5 percent and 80 percent of a thickness of the jacket. This yields an optimized sweeping result with contact of the sweeping element against the surface for cleaning by means of a sweeping edge. The form of a sweeping edge is independent of a pivoting position of the surface cleaning machine relative to the surface for cleaning.

In one exemplary embodiment, the sweeping element is formed in at least two parts with a first part and a second part, wherein the second part has greater elasticity than the first part and the front region is arranged or formed on the second part. By means of a two-part form, it is possible to realize a functional separation at the sweeping element. The second part can be formed with relatively high elasticity in order to ensure penetration of the front region into the jacket of the at least one cleaning roller at least during cleaning operation. The first part serves for holding and positioning the second part.

The first part also serves for guiding a flow of fluid to one or more suction mouths.

It is provided in particular that the first part has no elasticity that is functional for the sweeping element. The first part may have such a small amount of inherent elasticity that, in a normal operating mode, the first part cannot deflect elastically. For example, the first part is produced from a glass-fiber-reinforced plastic.

The second part has in particular a Shore hardness in the range between 70 and 90 in order to permit an elastic deflection. The second part is for example produced from an elastomer.

It is very particularly advantageous if the sweeping element is formed such that a sweeping edge always abuts against the second part during cleaning operation. The sweeping edge is the contact line by means of which the sweeping element lies against the surface for cleaning. By means of this construction, it is ensured that the sweeping edge lies against the elastic part of the sweeping element during cleaning operation. The front region of the sweeping element, which in turn forms the second part or is formed on said second part, penetrates into the jacket of the at least one cleaning roller. In this way, it is achieved that an elastic deflection is possible, and thus an optimized effect of sweeping and entrainment of "swept-up" coarse dirt by the at least one cleaning roller is possible. Thus good sweeping effect and entrainment effect is in this case ensured for all angular positions of the surface cleaning machine relative to the surface for cleaning, when said surface cleaning machine is set down by means of the at least one cleaning roller on the surface for cleaning.

In particular, the second part follows the first part in a circumferential direction, and in particular the second part is connected to the first part. In this way, it is possible for a one-piece (but multi-part) sweeping element to be provided which makes it possible to realize an optimized sweeping result.

In particular, the first part has a cylindrical surface facing toward the cleaning roller. Said cylindrical surface forms a "smooth" flow-guiding surface, past which a fluid flow for removal by suction can be conducted.

It is very particularly advantageous if the sweeping element is produced by means of a multi-component injection molding process, and in particular a two-component injection molding process. It is thereby possible to produce a sweeping element of multi-part functionality but of one piece construction. Said one-piece sweeping element can be easily fixed, and for example clipped onto, the cleaning roller holder. By means of a multi-component injection molding process, it is possible to easily realize different material characteristics for the first part and the second part. In particular, it is possible to realize different elastic characteristics.

It is expedient if, in the front region or in a partial section of the front region, a thickness of the sweeping element tapers toward the front face end. In this way, a penetrating action into the jacket of the at least one cleaning roller can be realized in a simple manner.

It is furthermore expedient if the front region is formed such that, at least during cleaning operation, a spacing between an outer side, facing toward the at least one cleaning roller, of the front region and an axis of rotation of the cleaning roller decreases, at least in a partial section, toward the front face end. In this way, penetrating of the sweeping element with its front region into the jacket of the at least one cleaning roller, with the advantages described above, is ensured.

It is expedient if the sweeping element has a first region and a second region which follow one another along an axis of rotation of the sweeping element of the at least one cleaning roller, wherein at least one through-recess is arranged between the first region and the second region. It is for example possible for a shaft of the at least one cleaning roller to be coupled to a corresponding drive device through the through-recess. It is thus possible to realize a central drive of the at least one cleaning roller. In this way, in turn, a good edge cleaning capability of the corresponding surface cleaning machine on both sides is realized.

For the same reasons, it is expedient if the at least one cleaning roller is formed in at least two parts with a first part, which is associated with the first region of the sweeping element, and a second part, which is associated with the second region of the sweeping element, wherein one or more coupling elements of the drive device which couple the drive device to the at least one cleaning roller extend through the at least one through-recess. It is thus possible to realize a surface cleaning machine with a central drive of the at least one cleaning roller. It is then for example no longer necessary for the at least one cleaning roller to be mounted at an outer side. In this way, in turn, good cleaning performance is realized even at edge regions on both sides.

It is expedient if the first region and the second region of the sweeping element are connected by means of a web. In this way, it is possible in particular for the sweeping element to be formed as one part.

A sliding surface may be formed on the web, wherein, in particular, an associated counterpart sliding surface has no jacket. The associated counterpart sliding surface is for example arranged on the at least one cleaning roller or on a shaft for the at least one cleaning roller.

It is very particularly advantageous if, during cleaning operation of the surface cleaning machine in which the at least one cleaning roller is set down on a surface for cleaning, the front face end projects into the jacket of the at least one cleaning roller and does not abut against the surface for cleaning, and in particular if a sweeping edge which abuts against the surface for cleaning is spaced apart from the front face end. It can thereby be ensured that the front region extends in and can on the other hand form a sweeping edge which is a contact line of the sweeping element against the surface for cleaning. It is thus possible for coarse dirt to be fed to the at least one cleaning roller by means of the sweeping element even in the event of variation of an angular position of the surface cleaning machine relative to the surface for cleaning.

In one exemplary embodiment, the sweeping element is arranged fixedly on the cleaning roller holder and is arranged in particular in non-displaceable and non-rotatable manner on the cleaning roller holder. Movability of the sweeping element and in particular of a partial region of the sweeping element relative to the cleaning roller holder is possible by means of an elastic form or partially elastic form of the sweeping element.

In an alternative embodiment, the sweeping element is arranged in movable and in particular rotatable manner on the cleaning roller holder. By means of a rotatable arrangement, the sweeping element as a whole is movable relative to the cleaning roller holder and thus also relative to the at least one cleaning roller. It is thus likewise possible to achieve a uniform spacing between the rotating cleaning roller and the sweeping edge regardless of an angular position of the surface cleaning machine relative to the surface for cleaning when the at least one cleaning roller is set down on said surface for cleaning. The rotatability of the sweeping element permits a corresponding adaptation. It is also advantageous here if a front region of the sweeping element projects into the jacket of the at least one cleaning roller.

It is expedient if, during cleaning operation with the surface cleaning machine being pushed forward, a direction of rotation of the at least one cleaning roller is clockwise. This yields an optimized dirt dissolving action.

It is furthermore expedient if, in the case of the surface cleaning machine with an at least one cleaning roller set down on a surface for cleaning being pushed in a forward direction, the sweeping element, facing away from the forward direction, covers the at least one cleaning roller in the rearward direction, and lies against the surface for cleaning at least over a length of the at least one cleaning roller. This yields an optimized sweeping function. In particular, a gap is present between a sweeping edge (by means of which the sweeping element abuts against the surface for cleaning) and the at least one cleaning roller. Said gap is dimensioned such that correspondingly coarse dirt which accumulates on the sweeping element can be entrained by the at least one rotating cleaning roller.

Here, the sweeping edge lies in particular on an elastic region of the sweeping element.

It is furthermore expedient if a wetting device for the cleaning roller is provided. It is thus possible for the rotating cleaning roller to be directly or indirectly moistened. In the case of direct moistening, cleaning liquid is applied directly to the at least one cleaning roller. In the case of indirect moistening, cleaning liquid is applied to the surface for cleaning, and the at least one cleaning roller takes up liquid from there. A combination of direct and indirect moistening is also possible. By means of cleaning liquid provided by means of the wetting device, dirt on the surface for cleaning can be more effectively detached and entrained.

The following description of preferred embodiments serves, in conjunction with the drawings, for explaining the invention in more detail.

DETAILED DESCRIPTION OF THE INVENTION

Figure 1:
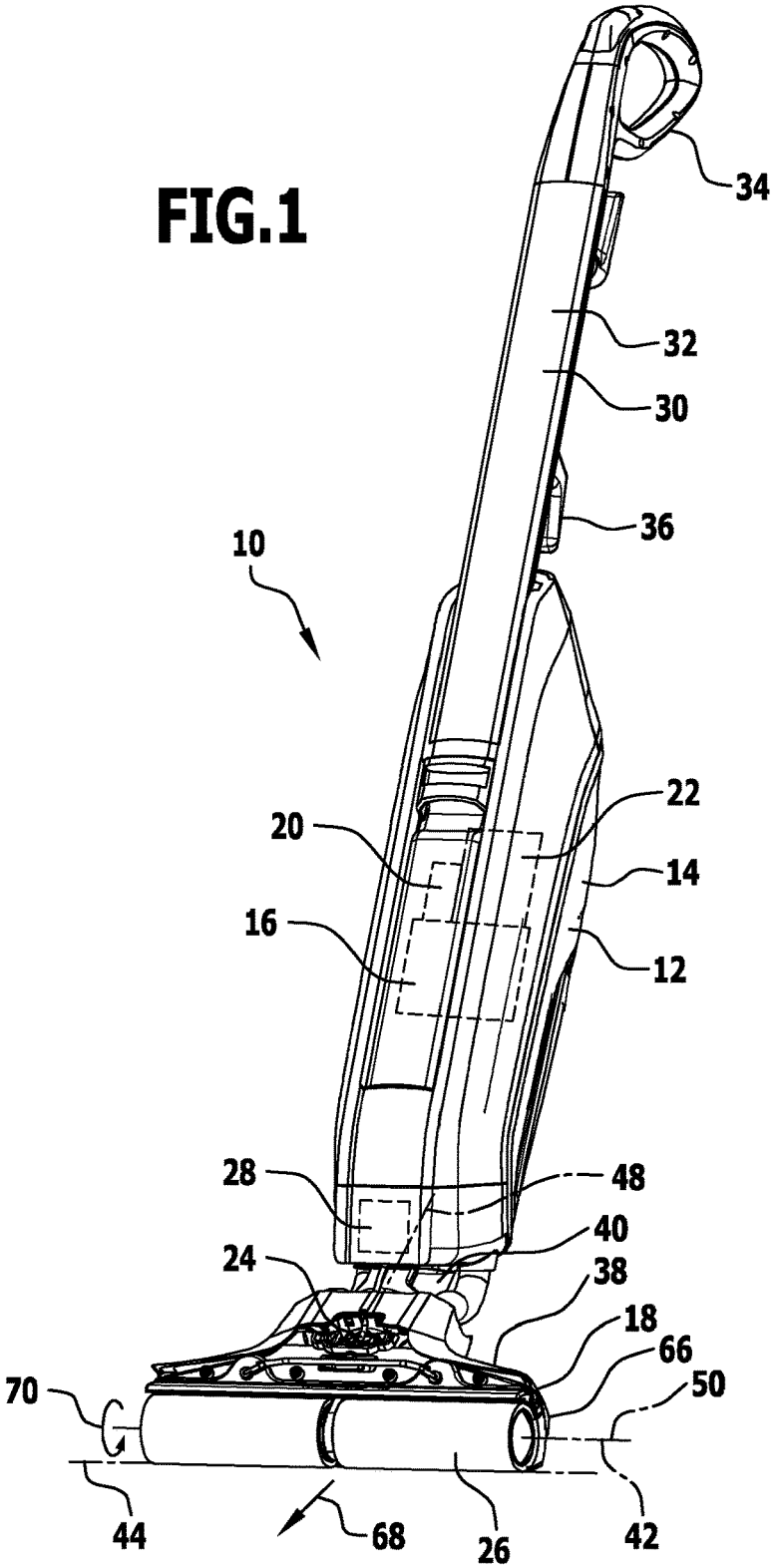
FIG. 1 is a perspective illustration of a first exemplary embodiment of a surface cleaning machine.

A first exemplary embodiment of a surface cleaning machine according to the invention, which is shown in FIG. 1, serves for cleaning (hard) floors. It is thus a floor cleaning machine. The surface-floor cleaning machine 10 comprises an appliance body 12 with a housing 14. Components of the surface-floor cleaning machine 10 are arranged in protected fashion in the housing 14.

In an exemplary embodiment, a suction apparatus 16 is arranged in the housing 14, which suction apparatus comprises a fan device and a motor device (in particular electric motor device) for driving the fan device. By means of the suction apparatus 16, a suction flow is generated for effecting removal by suction at a cleaning head 18.

In the housing 14 there is also arranged a separator device 20 which separates solid and liquid components in a suction flow from one another. Furthermore, in the housing 14, there is arranged a reservoir device 22 for (sucked-in) dirty liquid. The reservoir device 22 is positioned in particular in removable fashion on the housing 14.

The surface cleaning machine 10 comprises a wetting device 24 by means of which cleaning liquid (water or water with an additional detergent) can be provided to a cleaning roller 26 of the cleaning head 18. A reservoir device 28 for cleaning liquid is arranged in the housing 14, which reservoir device provides said cleaning liquid to the wetting device 24.

The surface cleaning machine 10 is handheld. A holder 30 is arranged on the appliance body 12. Said holder 30 comprises a holding rod 32, on the end region of which there is seated a holding handle 34. The holding handle 34 is in particular in the form of a stirrup-shaped handle. Operating elements, and in particular a switch for switching on and switching off corresponding devices of the surface cleaning machine 10, are arranged in the region of the holding handle 34.

A winding device 36 for a mains electrical cable may be arranged on the holding rod 32.

The cleaning head 18 is positioned on the appliance body 12 at an end remote from the holding handle 34. Said cleaning head is for example arranged pivotably on the appliance body 12.

The cleaning head 18 comprises a cleaning roller holder 38 on which the cleaning roller 26 is seated.

The cleaning roller 26 is associated with a drive device 40 which comprises, in particular, a drive motor. The drive device 40 is arranged in the housing 14 or is arranged in the cleaning head 18.

In an exemplary embodiment, one part of the drive device 40 is arranged in the housing 14 and one part is arranged on the cleaning head 18.

The drive device 40 comprises, in particular, an electric motor. Said electric motor provides a torque for driving the cleaning roller 26 in rotation about an axis of rotation 42.

During operation of the surface cleaning machine 10, said surface cleaning machine is set down by means of the cleaning roller 26 on the surface for cleaning, and is supported exclusively by means of the cleaning roller 26 on said surface for cleaning. An operator holds the surface cleaning machine 10 by the holding handle 34, wherein, during normal operation, the operator is standing. The operator can adjust an angular position of the surface cleaning machine 10 (an angular position of the holding rod 32) relative to the surface for cleaning. This is realized by means of the angular positioning of the appliance 10 as a whole relative to the surface for cleaning.

Figure 9B:
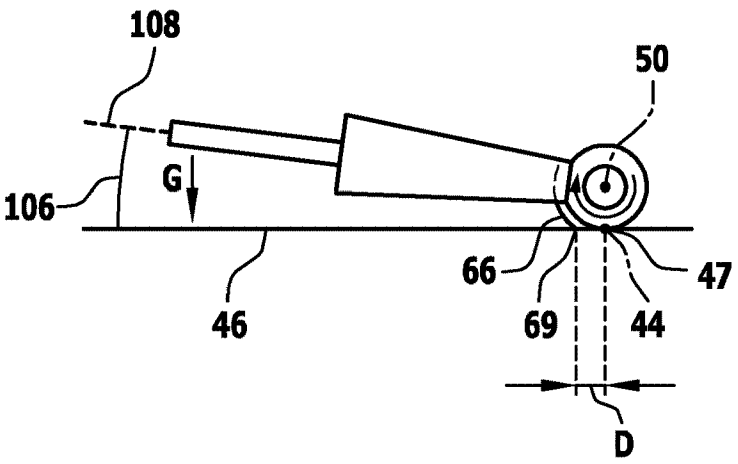
FIGS. 9(*a*), (*b*) show different angular positions of the surface cleaning machine relative to a surface for cleaning, with different rotational positions of a sweeping element.
Figure 9A:
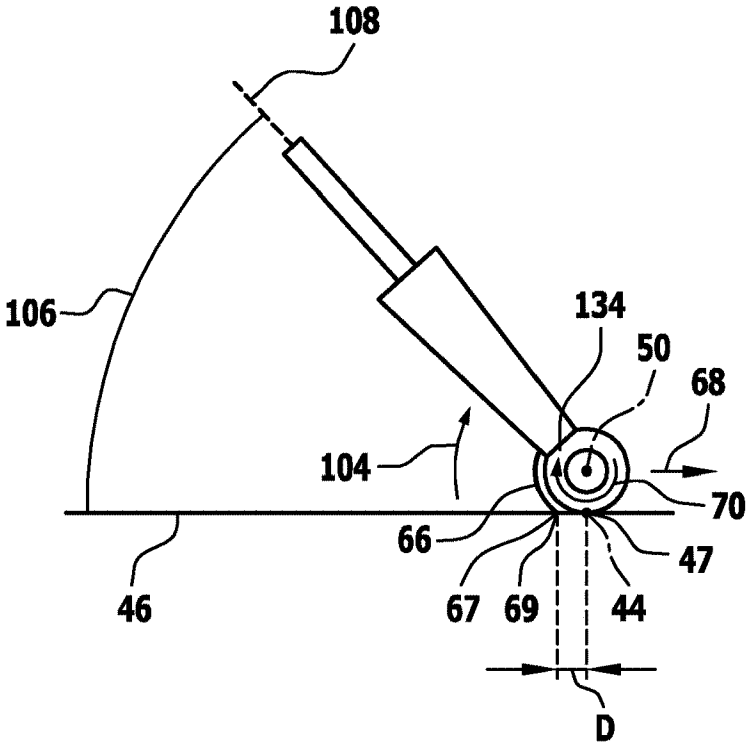

A pivot axis 44 for such an angular movement (cf. also FIGS. 9(*a*) and 9(*b*)) is formed by the contact region of the cleaning roller 26 against a surface 46 for cleaning.

A pivot axis 48 for possible pivotability of the cleaning head 18 relative to the appliance body 12 lies transversely with respect to said pivot axis 44 or transversely with respect to the axis of rotation 42.

The cleaning roller 26 has a longitudinal axis 50. Said longitudinal axis 50 is coaxial with respect to the axis of rotation 42. During cleaning operation of the surface cleaning machine 10, the longitudinal axis 50 lies coaxially with respect to the surface for cleaning 46. The pivot axis 44 for pivoting of the appliance 10 as a whole relative to the surface for cleaning 46 is at least approximately parallel to said longitudinal axis 50.

Figure 2:
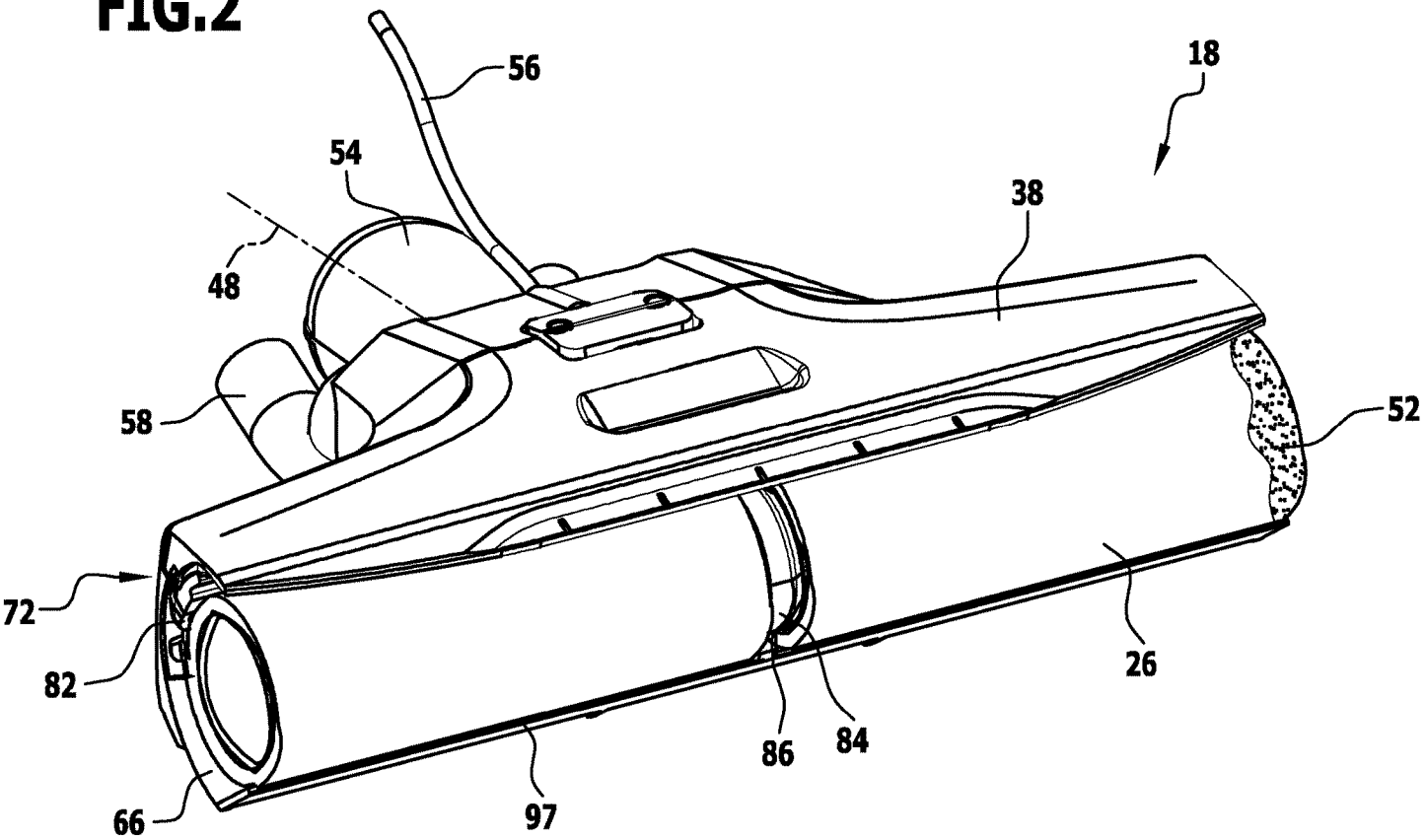
FIG. 2 is a perspective illustration of a roller region of the surface cleaning machine as per FIG. 1.
Figure 3:
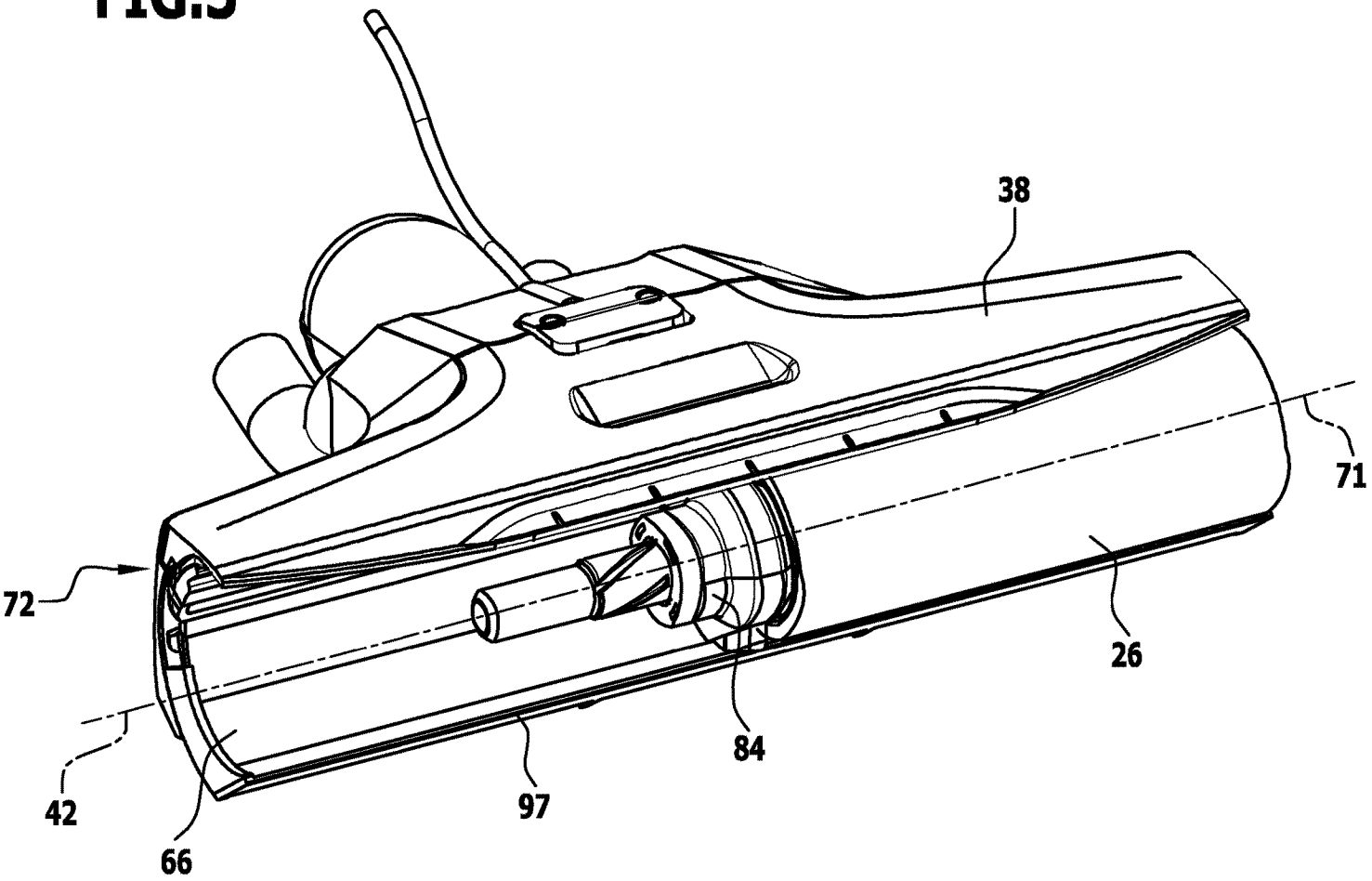
FIG. 3 is a partial illustration of the roller region as per FIG. 2.
Figure 4:
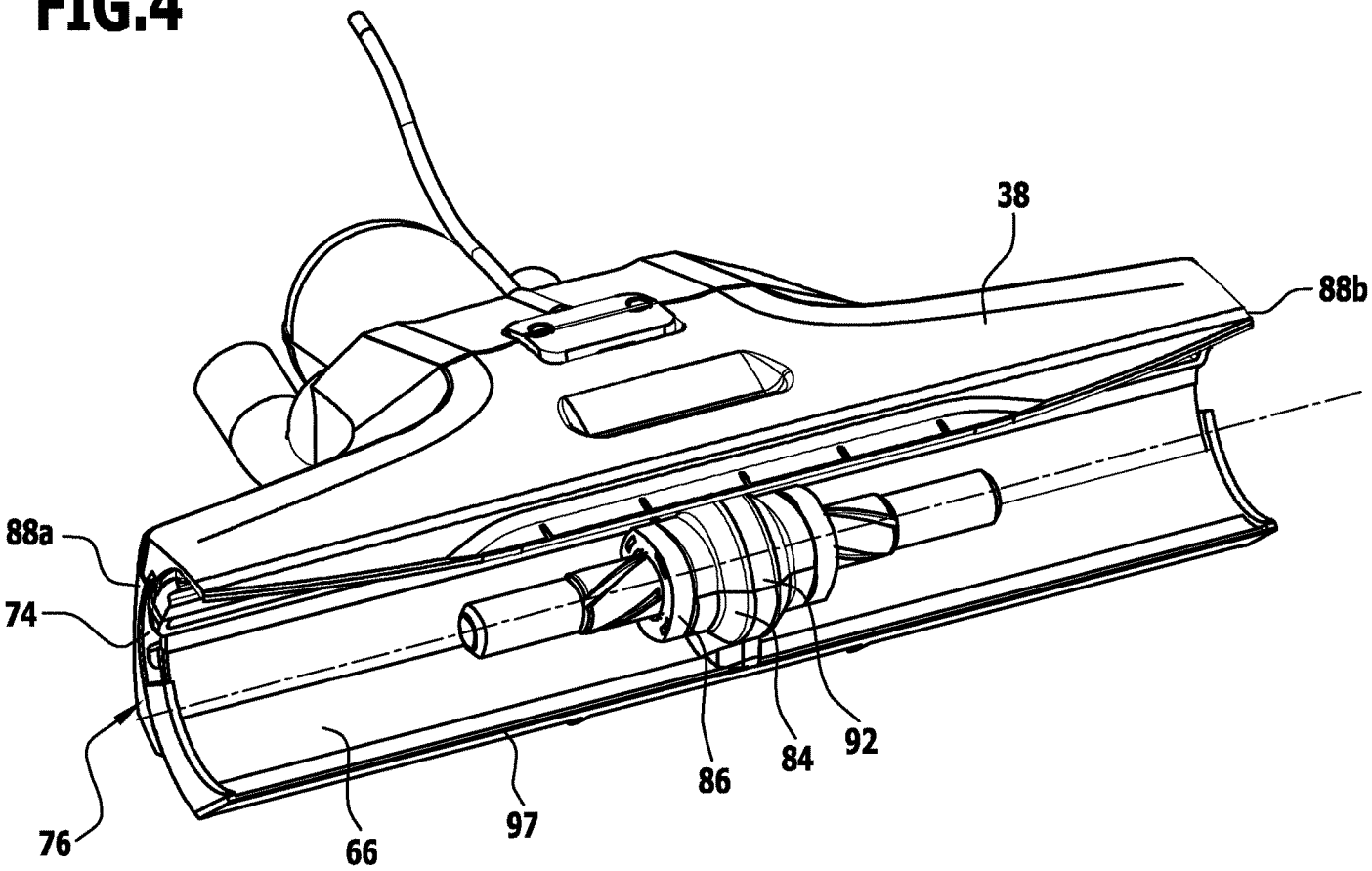
FIG. 4 is a further partial illustration of the roller region as per FIG. 2.

As indicated in FIG. 2 by the reference numeral 52, the cleaning roller 26 is equipped with a jacket.

The cleaning head 18 (cf. also FIGS. 3 to 8) with the cleaning roller holder 38 is provided for in particular detachable connection to the appliance body 12. Said cleaning head comprises a connector 54 which is arranged on the cleaning roller holder 38 and by means of which pivotable mounting of the cleaning head 38 on the appliance body 12 is realized.

From the reservoir device 28, which is arranged in particular on the housing 14, one or more liquid lines 56 lead to the wetting device 24 of the cleaning head 18. On the cleaning roller holder 38 there are arranged nozzles via which cleaning liquid can be applied to the cleaning roller 26.

It is alternatively or additionally possible for (the) nozzles to be arranged such that cleaning liquid is applied directly to the surface for cleaning 46, and then indirectly to the cleaning roller 26 by virtue of cleaning liquid being taken up from the surface for cleaning 46.

For operation of the surface cleaning machine 10, it is provided in particular that cleaning liquid is not applied directly to the surface for cleaning 46, but rather that the cleaning roller 26 with its jacket 52 is moistened, and then the moistened cleaning roller 26 acts on the surface for cleaning 46.

Furthermore, one or more connections 58 for a suction flow are provided on the cleaning head 18 and, here, on the cleaning roller holder 38. Such a connection 58 is fluidically connected via one or more suction lines to the suction apparatus 16.

On the cleaning roller holder 38 there is arranged (at least) one suction mouth 60 (cf. FIG. 7) which is directed toward the cleaning roller 26. The suction mouth 60 is fluidically connected to the connection 58 and thus to the suction apparatus 16. A negative-pressure flow prevails at the suction mouth 60. Pieces of dirt are removed by suction by means of said negative-pressure flow.

In one exemplary embodiment, the suction mouth 60 is, when the cleaning roller 26 is set down on the surface for cleaning 46, arranged above the cleaning roller 26 in relation to the surface for cleaning 46.

In one exemplary embodiment, the suction mouth 60 has a first mouth wall 62 and a second mouth wall 64. The suction mouth 60 with a corresponding mouth opening is formed between said mouth walls. The first mouth wall 62 is situated above the second mouth wall 64. The first mouth wall 62 and/or the second mouth wall 64 lie against the jacket 52 of the cleaning roller 26, or in particular project into said jacket. This implementation is described in the international patent application PCT/EP2013/076445, dated Dec. 12, 2013, from the same applicant, which does not constitute a prior publication. The entire content of said document is incorporated by reference.

The cleaning head 18 has a sweeping element 66 which is associated with the cleaning roller 26.

During ("normal") cleaning operation, it is for example the case that the surface cleaning machine 10 is pushed forward in a forward direction 68 (cf. FIG. 1). The cleaning roller 26 rotates clockwise 70. A region of the cleaning roller 26 is moistened by the wetting device 24 before coming into contact with the surface for cleaning 46. Said region then rotates toward the surface for cleaning 46. Dirt is dissolved. As a result of the rotation of the cleaning roller 26 on the surface for cleaning 46, dirt is entrained and is fed to the suction mouth 60. Removal by suction can be realized there.

By means of the sweeping element 66, coarse dirt that has for example not been directly entrained by the cleaning roller 26 can be "collected" and then entrained by means of the cleaning roller 26.

The sweeping element 66 is arranged on the cleaning roller holder 38. Translational transport of the sweeping element 66 is realized by means of the fixing to the cleaning roller holder 38. The sweeping element 66 is mechanically decoupled from the rotation of the cleaning roller 26.

During cleaning operation, the sweeping element 66 covers a rear side of the cleaning head 18, wherein the rear side is situated behind the cleaning roller 26 in the opposite direction to the forward direction 68. The sweeping element 66 extends at least and in particular substantially exactly over the length of the cleaning roller 26 along the longitudinal axis 50. During normal operation, the sweeping element 66 abuts against the surface for cleaning 46.

During normal operation, the sweeping element 66 is situated between the surface for cleaning 46 and the suction mouth 60.

The sweeping element 66 is held rotatably on the cleaning roller holder 38. An axis of rotation 71 (cf. for example FIG. 3) for the rotatability of the sweeping element 66 on the cleaning roller holder 38 is parallel and in particular coaxial with respect to the axis of rotation 42 for the rotation of the cleaning roller 26.

The sweeping element 66 is in particular guided on a circular path.

For this purpose, the cleaning roller holder 38 is equipped with a first guide device 72 for the sweeping element 66. The first guide device 72 (FIGS. 2 to 6) is arranged on an inner side 74, which faces toward the cleaning roller 26, of the cleaning roller holder 38.

The sweeping element 66 is equipped with a second guide device 76 which cooperates with the first guide device 72 of the cleaning roller holder 38 for the purposes of guiding the sweeping element 66 on a circular path on the cleaning roller holder 38.

The second guide device 76 (FIG. 5) has guide elements 78*a*, 78*b* arranged on face sides of the sweeping element 66. The guide elements 78*a*, 78*b* have in each case one insertion region 80, for example of dovetail-shaped form.

The first guide device 72 has, associated with the guide elements 78*a*, 78*b*, in each case on face sides of the cleaning roller holder 38, guide tracks 82 into which the respective insertion region 80 penetrates. In this way, forced guidance (on a circular path) of the sweeping element 66 on the cleaning roller holder 38 is realized.

The drive device 40 comprises a transmission device 84. The latter in turn comprises a partial region 86 (FIGS. 2 to 4) which is arranged, facing toward the inner side 74, on the cleaning roller holder 38. Said region 86 is in this case arranged centrally between opposite face sides 88*a*, 88*b* of the cleaning roller holder 38.

The cleaning roller 26 is for example in two-part form and is seated on, and driven via, the region 86.

A divider 90 is seated on the cleaning roller holder 38 on the inner side 74 centrally between the face sides 88*a*, 88*b*. Said divider serves for dividing up dirt or dirty fluid to the left and to the right.

The sweeping element 66 comprises a sliding region 94. Said sliding region 94 is for example in the form of a cylindrical shell or part of a cylindrical shell. The sliding region 94 is for example produced from a metal material, and for example from sheet metal.

The sliding region 94 abuts against the inner side 74 of the cleaning roller holder 38 and slides on the latter during a rotational movement of the sweeping element 66.

A contact region 96 is seated on the sliding region 94 of the sweeping element 66. The contact region 96 forms a contact lip against the surface for cleaning 46. The contact region 96 is produced from an elastic material and in particular rubber material in order to realize easily adaptable contact against the surface for cleaning 46.

The sliding region 94 forms a first part of the sweeping element 66 and the contact region 96 forms a second part of the sweeping element 66.

The contact region 96 is a front region of the sweeping element 66, which front region has a front face end 97.

It is basically possible for the sliding region 94 to be produced with such a stiffness that no flexible deformation occurs during normal operation.

In an alternative embodiment, the sliding region 94 is produced to be so flexible that rearward bulging away from the cleaning roller 26 (counter to the forward direction 68) is possible. Such bulging may arise as a result of accumulation of dirt, and may under some circumstances increase the cleaning action.

Figure 5:
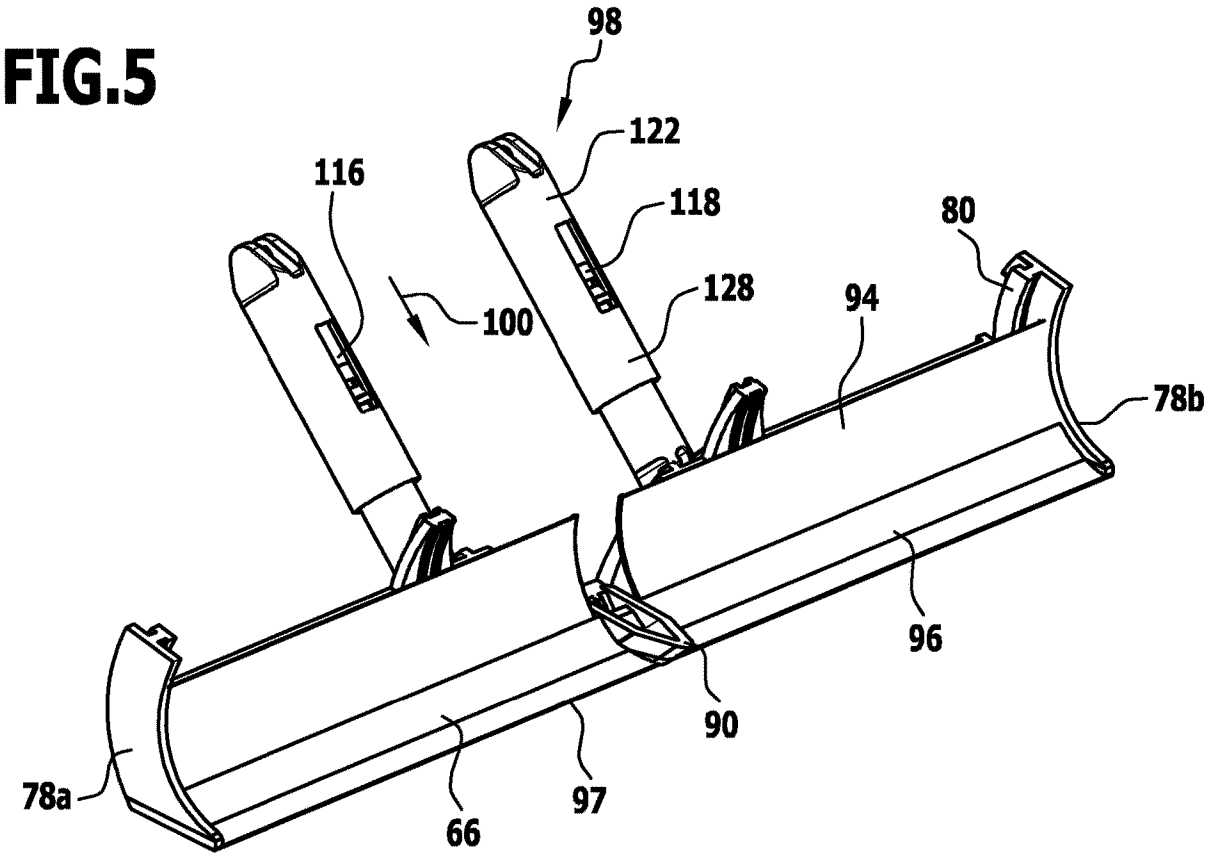
FIG. 5 shows a perspective view of an exemplary embodiment of a sweeping element which is arranged at the roller region as per FIG. 2.
Figure 6:
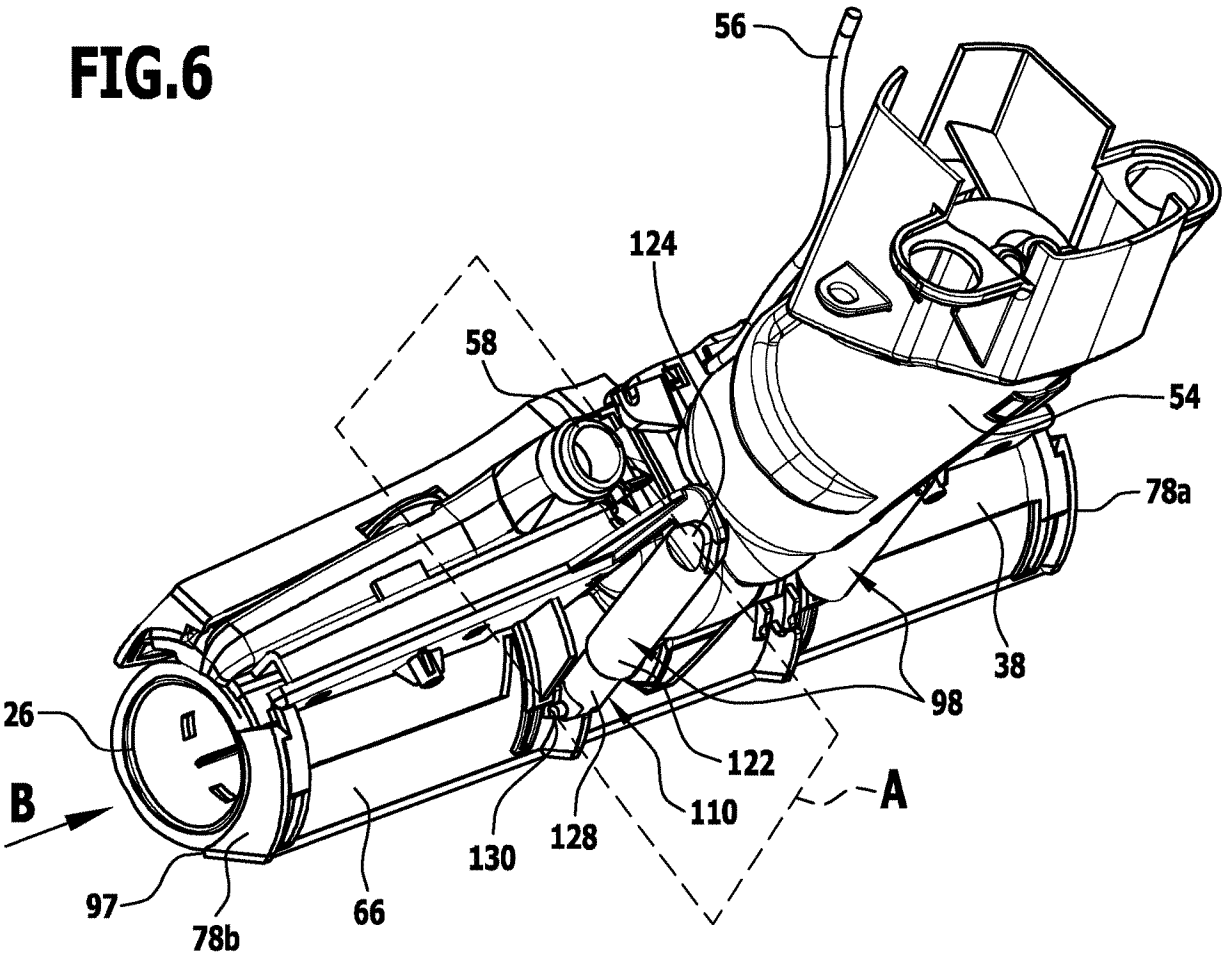
FIG. 6 is a further perspective illustration of the roller region as per FIG. 2.
Figure 7:
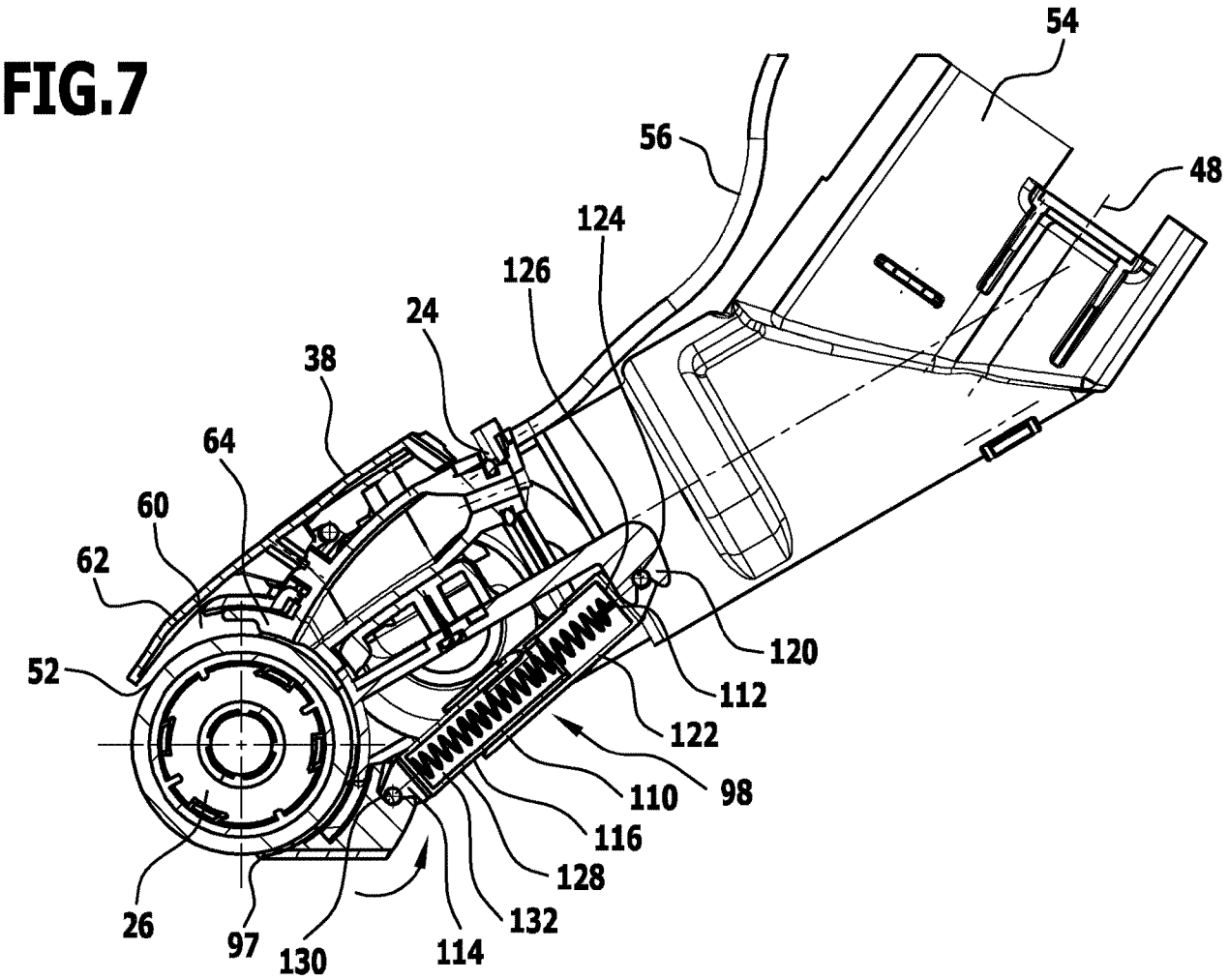
FIG. 7 shows a sectional view in the section plane A as per FIG. 6.

The sweeping element 66 is additionally supported on the cleaning roller holder 38 by means of an elastic device 98 (FIGS. 5 to 7). The elastic device 98 provides a spring force 100 which is directed so as to push the sweeping element 66, by way of the contact region 96, onto the surface for cleaning 46. Said spring force 100 effects a rotation of the sweeping element 66 counterclockwise relative to the cleaning roller holder 38. The spring force 100 is directed such that a maximum (rotational) deflection of the sweeping element 66 relative to the cleaning roller holder 38 is realized.

Said maximum rotatability is limited by a stop. In particular, a stop of the guide elements 78*a*, 78*b* against a corresponding stop element of the guide track 82 limits further rotatability.

For a rotation of the sweeping element 66 relative to the cleaning roller holder 38 clockwise (indicated in FIG. 9(*a*) by the reference numeral 104), the spring force 100 of the elastic device 98 must be overcome.

The elastic device 98 is in particular configured such that the weight force G of the surface cleaning machine 10 is sufficient to overcome the spring force.

Furthermore, the elastic device is formed such that the sweeping element 66 does not slide under the cleaning roller 26 and raise it under the action of the spring force 100. Through corresponding dimensioning of the elastic device 98, a raising of the cleaning roller 26 caused by the sweeping element 66 is thus prevented.

As a result of a change in an angular position 106 of the surface-floor cleaning machine 10 (in relation to a longitudinal axis 108 of said machine), the sweeping element 66 is then automatically moved into a correct rotational position relative to the cleaning roller holder 38. It is thereby possible to realize an optimum sweeping result and thus cleaning result regardless of the angular position 106 of the surface-floor cleaning machine 10.

Figure 8:
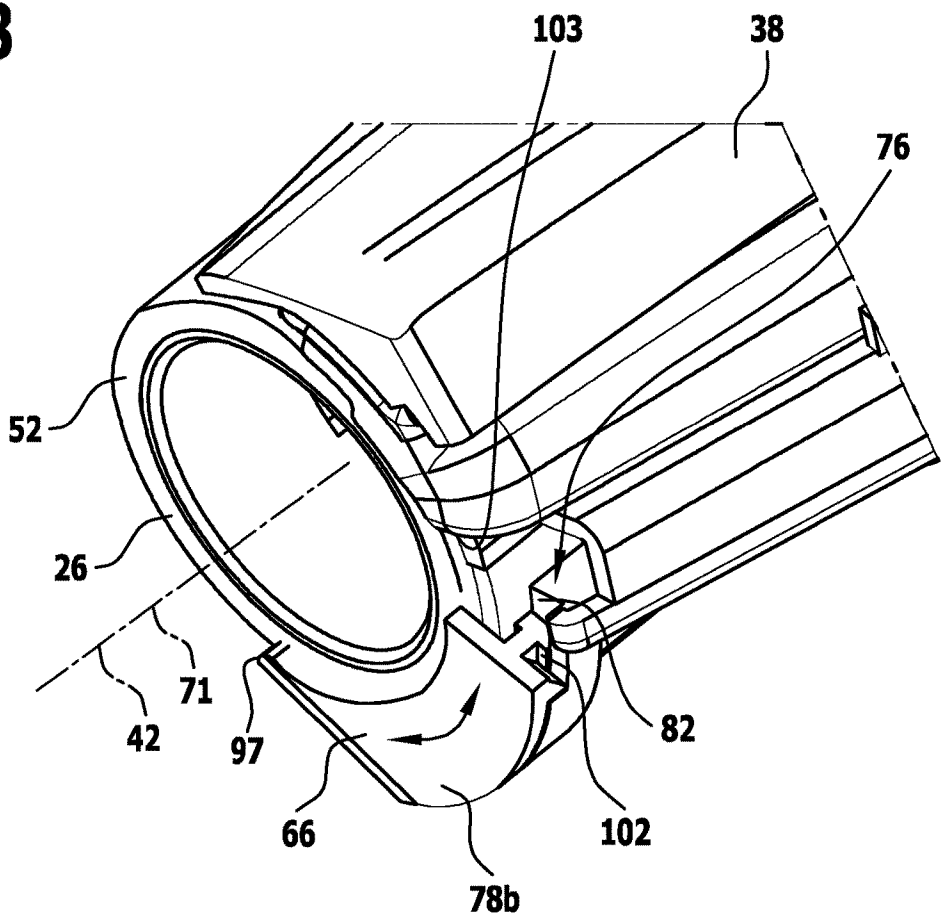
FIG. 8 shows a plan view of the roller region in the direction B as per FIG. 6.

An angle range for the rotatability of the sweeping element 66 on the cleaning roller holder 38 on its circular path lies in the region of at least 20° and in particular at least 30° and in particular at least 40°. In one exemplary embodiment, said angle range is approximately 55°. An initial position (zero angle) is defined by minimal deflection. For this purpose, a stop 102 is arranged on the sweeping element 66 (FIG. 8). The cleaning roller holder 38 has a counterpart element 103, and the initial position (0° position) is present when the stop 102 lies against the counterpart element 103. Proceeding from this position, a rotation in the stated angle range can then be made possible.

As already mentioned above, the physical rotational position of the sweeping element 66 relative to the cleaning roller holder 38, and thus the rotational angle relative to the initial position, is dependent on the angular position 106 of the surface cleaning machine 10 relative to the surface for cleaning 46.

The elastic device 98 comprises a spring device 110 which, at one end 112, is supported on the cleaning roller holder 38 and, at an opposite end 114, is supported on the sweeping element 66 in order to be able to impart the corresponding spring force 100 for driving the sweeping element 66 in rotation. (If the cleaning head 18 is seated immovably on the appliance body 12, then the spring device 110 may also be supported, at the end 112, on the appliance body 12.)

In one exemplary embodiment, the spring device 110 comprises a first spring 116 and a second spring 118. The first spring 116 and the second spring 118 are for example in the form of helical springs.

The first spring 116 and the second spring 118 are spaced apart in a direction between face sides of the sweeping element 66.

The first spring 116 and the second spring 118 are arranged such that, between them, a part of the drive device 40 is led to the region 86.

The divider 90 is situated between the first spring 116 and the second spring 118.

For the fixing of the spring device 110, a support element 120 is arranged on the cleaning roller holder 38 so as to be associated with in each case to the first spring 116 and to the second spring 118. A first housing part 122 is pivotably articulated on said support element 120 at a pivot bearing 124. A pivot axis of the pivot bearing 124 lies parallel to the axis of rotation 71 of the sweeping element 66.

The first housing part 122 is for example of cylindrical form.

The corresponding spring 116 or 118 is supported by way of its end 112 on a base 126 of said first housing part 122, wherein said base 126 is situated adjacent to the pivot bearing 124.

Furthermore, a second housing part 128 is provided. Said second housing part 128 is pushed in the manner of a sleeve onto the first housing part 122.

The second housing part 128 is pivotably articulated on the sweeping element 66 by means of a pivot bearing 130. A pivot axis of the pivot bearing 130 is parallel to the pivot axis of the pivot bearing 124, and thus parallel to the axis of rotation 71.

The second housing part 128 has a base 132 which is situated adjacent to the pivot bearing 130. The corresponding spring 116 or 118 is supported on the base 132 by means of the end 114.

The first housing part 122 and the second housing part 128 form a housing. The corresponding spring 116 or 118 is arranged in protected fashion in the interior of said housing.

Owing to the pivotable articulation of the spring 116 or 118 respectively both on the cleaning roller holder 38 and on the sweeping element 66 by means of the first housing part 122 and the second housing part 128, the spring force 100 can be imparted in all rotational positions of the sweeping element 66 relative to the cleaning roller holder 38 on the corresponding circular path.

For the cleaning of a surface for cleaning 46 (for example a floor surface), the surface cleaning machine 10 functions as follows:

The surface cleaning machine 10 is set down by means of the cleaning roller 26 on the surface for cleaning 46, with a contact line 47 being formed. An operator holds the surface cleaning machine 10 for example using one hand on the holding handle 34. Here, the operator adjusts an angular position 106 of the surface cleaning machine 10 relative to the surface for cleaning 46. Said angular position 106 can be varied (cf. FIG. 9(*b*)) in order, for example, to perform cleaning under an item of furniture.

The surface cleaning machine 10 is switched on by actuating a switch. A rotation of the cleaning roller 26 about the axis of rotation 42 is actuated. Said cleaning roller is driven by the drive device 40. Furthermore, the suction apparatus 16 is actuated, which suction apparatus generates a suction flow which acts on the cleaning roller 26 at the suction mouth 60. Furthermore, moistening of the cleaning roller 26 by means of the wetting device 24 is actuated.

If for example the surface cleaning machine 10 is pushed in the forward direction 68 (FIG. 1), then the cleaning roller 26 preferably rotates clockwise 70.

The moist cleaning roller 26 applies moisture to the surface for cleaning 46, and here, dirt is dissolved. The rotation of the cleaning roller 26 on the surface for cleaning 46 causes dirt to be entrained by the cleaning roller 26. Removal by suction occurs at the suction mouth 60.

The sweeping element 66 serves for collecting coarse dirt that has (initially) not been entrained by the cleaning roller 26 and for feeding said coarse dirt to the cleaning roller 26. Said coarse dirt can then be entrained by the cleaning roller 26 and removed by suction. The sweeping element 66 abuts by way of a sweeping edge 67 against the surface for cleaning 46 via a contact line 69.

The contact region 96 lies against the surface for cleaning 46 and ensures a corresponding entrainment action.

During normal operation of the surface cleaning machine 10, the front face end 97 of the sweeping element 66 is spaced apart from the sweeping edge 67. The sweeping element 66 penetrates with a section of a second part 96 (the contact region 96) into the jacket 52 of the cleaning roller 26. The front face end 97 projects into the jacket 52. Said front face end projects into the material, for example nonwoven material, of the jacket 52. This yields a good sweeping result.

The penetration of the sweeping element into the jacket 52 will be discussed in more detail below on the basis of the fourth exemplary embodiment.

In the embodiment described above, the sweeping element 66 is held rotatably on the cleaning roller holder 38. The sweeping element 66 is spring-loaded by the elastic device 98.

It is thereby automatically ensured that, in all angular positions 106 of the surface cleaning machine 10 relative to the surface for cleaning 46, the sweeping element 66 abuts by means of the contact region 96 against the surface for cleaning 46. The spring force 100 of the elastic device 98 presses said contact region 96 with the sweeping edge 67 against the surface for cleaning 46.

If the angle 106 is reduced (cf. FIG. 9(*b*)), then the sweeping element 66 can be moved conjointly owing to its rotatability. Overcoming the spring force 100, a movement takes place clockwise 104. In particular, the weight force G of the surface cleaning machine 10 is sufficient to correspondingly overcome the spring force 100. If necessary, a (slight) pressure imparted by the operator can ensure the movement.

A spacing D between the contact lines 69 and 47 (as the spacing between the contact points of the sweeping element 66 and of the cleaning roller 26 against the surface for cleaning 46) is minimized regardless of the angle 106.

In this way, a substantially uniform spacing (gap) is realized between the rotating cleaning roller 26 and the sweeping element 66, and in particular between the contact region 96 of the contact against the surface for cleaning 46 and a contact region of the cleaning roller 26 against the surface for cleaning 46. There is no offset. The sweeping element 66, by means of a sweeping edge, serves for sweeping up coarse dirt, and a carrying-away action by means of the cleaning roller 26 is ensured in all angular positions 106.

Owing to the variability of the angular position 106, a uniform spacing is ensured by means of the rotatability of the sweeping element 66 on the cleaning roller holder 38. A region between the sweeping element 66 and the cleaning roller 26 forms a suction duct 132 which is fluidically connected to the suction mouth 60. Owing to the rotatability of the sweeping element 66, an arc length between the surface for cleaning 46 and a projection of a mouth of the duct 132 onto the surface for cleaning 46 is bridged in variable fashion, and the corresponding spacing is kept substantially constant regardless of the angular position 126.

Regardless of the angular position 106 of the surface cleaning machine 10, it is possible for coarse dirt that collects on the sweeping element 66 to be swept up and carried away by means of the cleaning roller 26.

The elastic device 98, by means of its spring force 100, effects a restoring movement of the sweeping element 66 if for example the angle for an angular position 106 is increased (movement from the position as per FIG. 9(*b*) to the position as per FIG. 9(*a*)).

As already mentioned above, it is basically possible for the sliding region 94 of the sweeping element 66 to be of rigid form. In the case of a flexible form, bulging away from the cleaning roller 26 can be permitted. It is then possible for coarse dirt to accumulate in a corresponding bulge region in particular during lowering (reduction of the angle for the angular position 106). When the surface cleaning machine 10 is raised (increase of the angle of the angular position 106), said accumulated coarse dirt can then be transported away.

Figure 10:
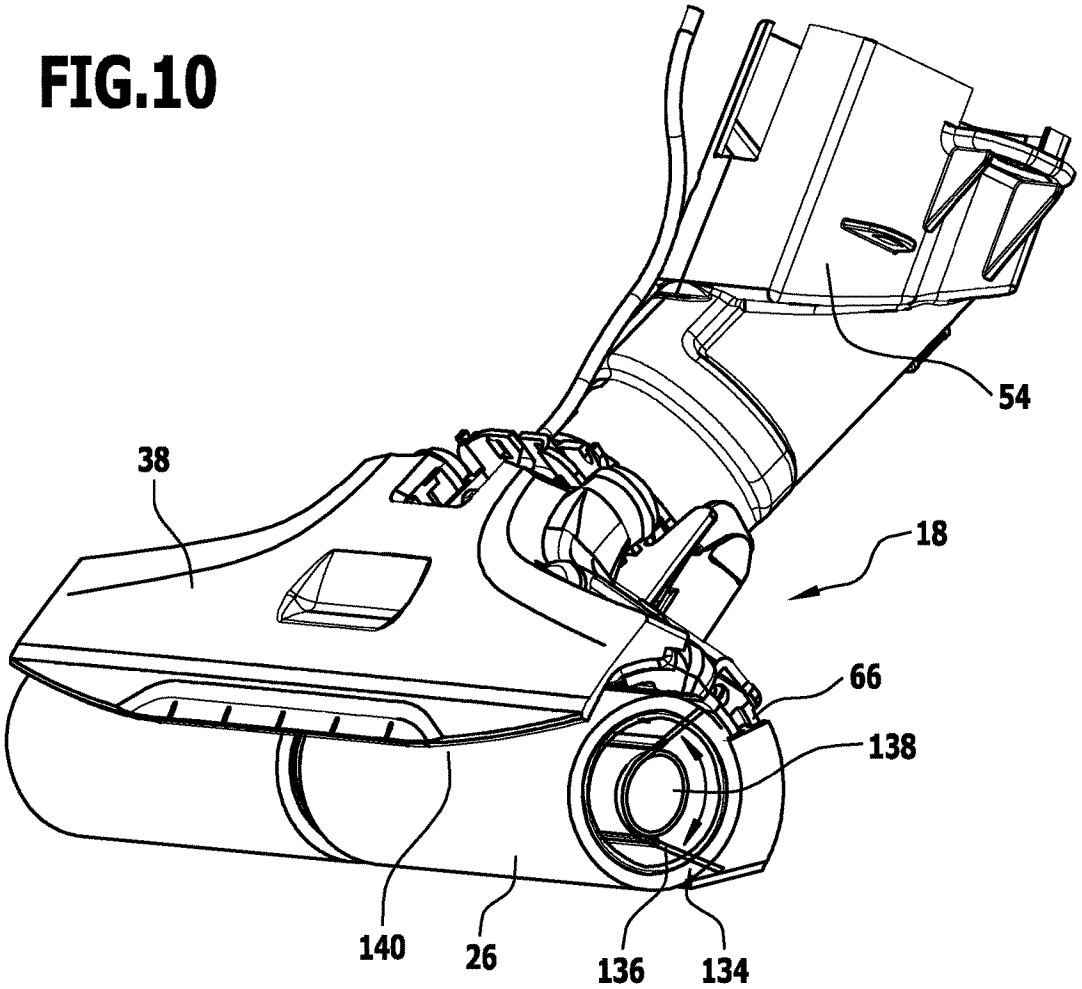
FIG. 10 is a perspective illustration of the roller region of a second exemplary embodiment of a surface cleaning machine.

In a second embodiment, which is schematically shown in FIG. 10, the cleaning head is basically of the same design as that described above. The same reference numerals are used for identical elements. This exemplary embodiment differs by the design of the elastic device. Here, an elastic device 134 is provided. The elastic device 134 comprises torsion springs 136 arranged at each face side on the corresponding sweeping element 66. Here, a torsion spring 136 is supported in each case on the sweeping element 66. Furthermore, a torsion spring 136 is supported on an element 138 which is part of or fixedly connected to the cleaning roller holder 38. Said element 138 is arranged in an interior space 140 of the cleaning roller holder 38. The cleaning roller 26 is also positioned in said interior space 140.

The element 138 is for example a rod which is situated coaxially with respect to the cleaning roller 26 and which is situated for example in an interior space of the cleaning roller 26. The cleaning roller 26 is in this case in particular in the form of a hollow roller.

Figure 11:
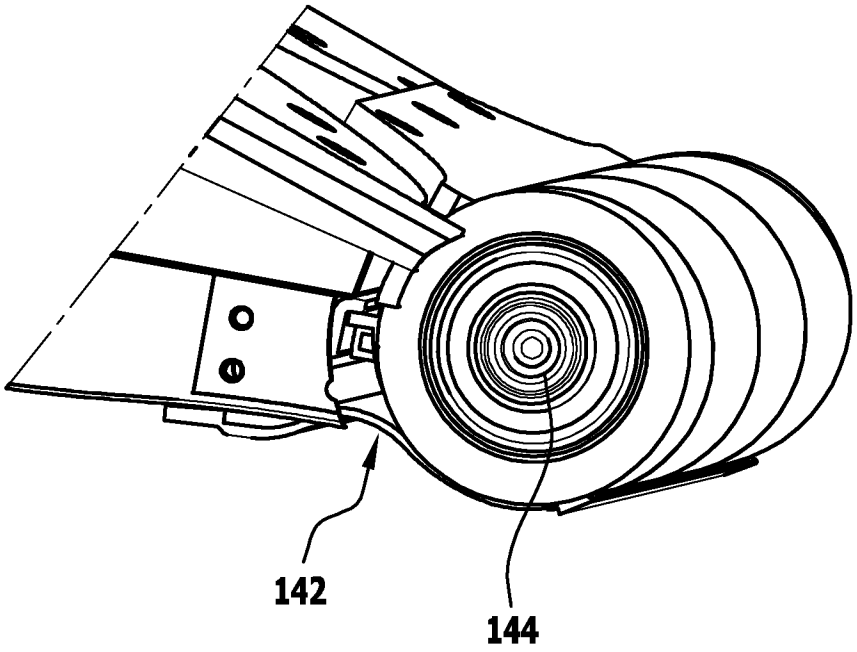
FIG. 11 is a partial illustration of the roller region of a third exemplary embodiment of a surface cleaning machine according to the invention.

In a third exemplary embodiment (FIG. 11), an elastic device 142 is provided which has a rubber spring 144 for generating the spring force 100. Said rubber spring 144 is in turn supported on the cleaning roller holder 38 and on the sweeping element 66.

Figure 12:
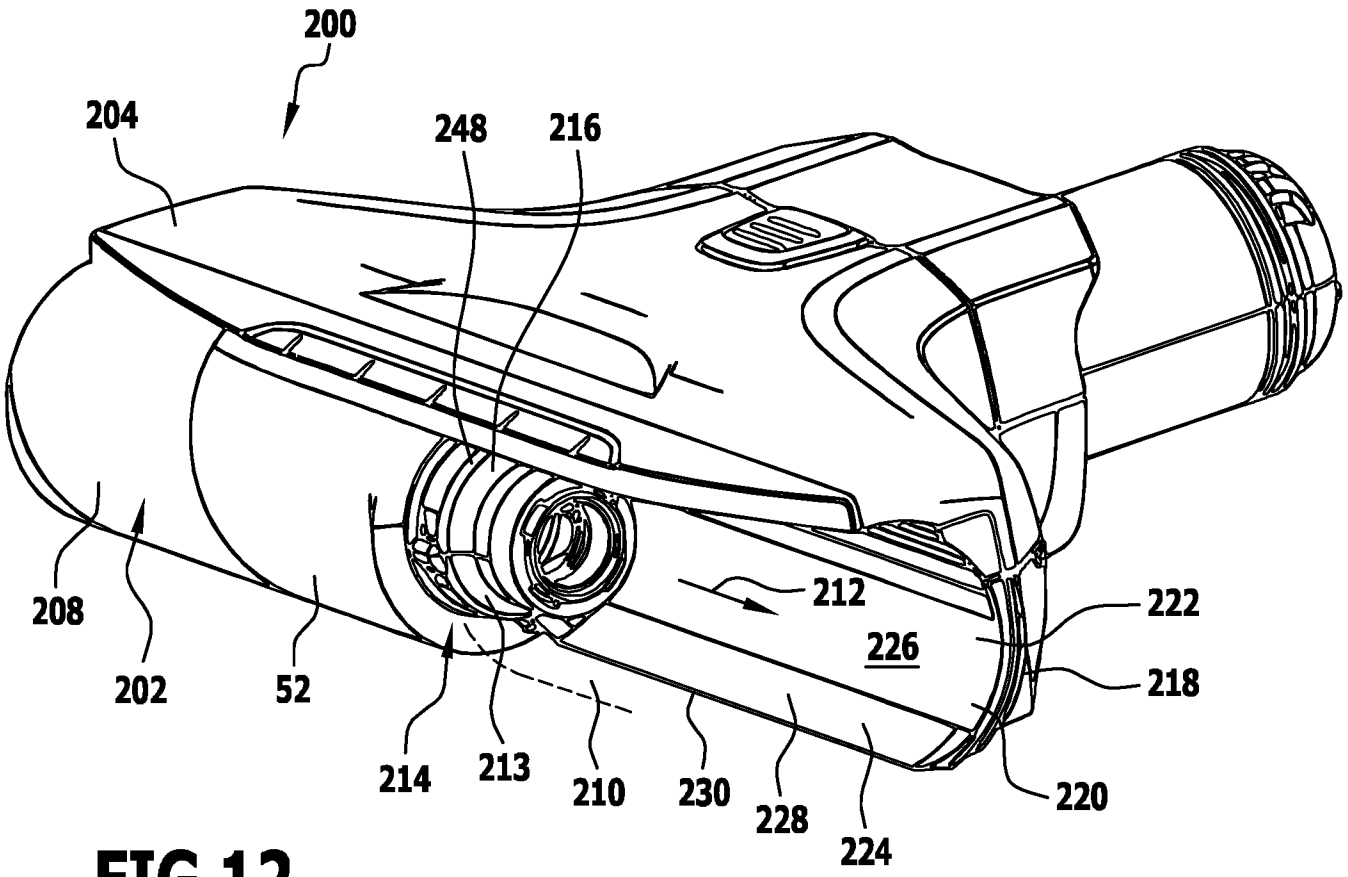
FIG. 12 shows a perspective view of a roller region of a fourth exemplary embodiment of a surface cleaning machine according to the invention, with a cleaning roller being only partially shown.
Figure 13:
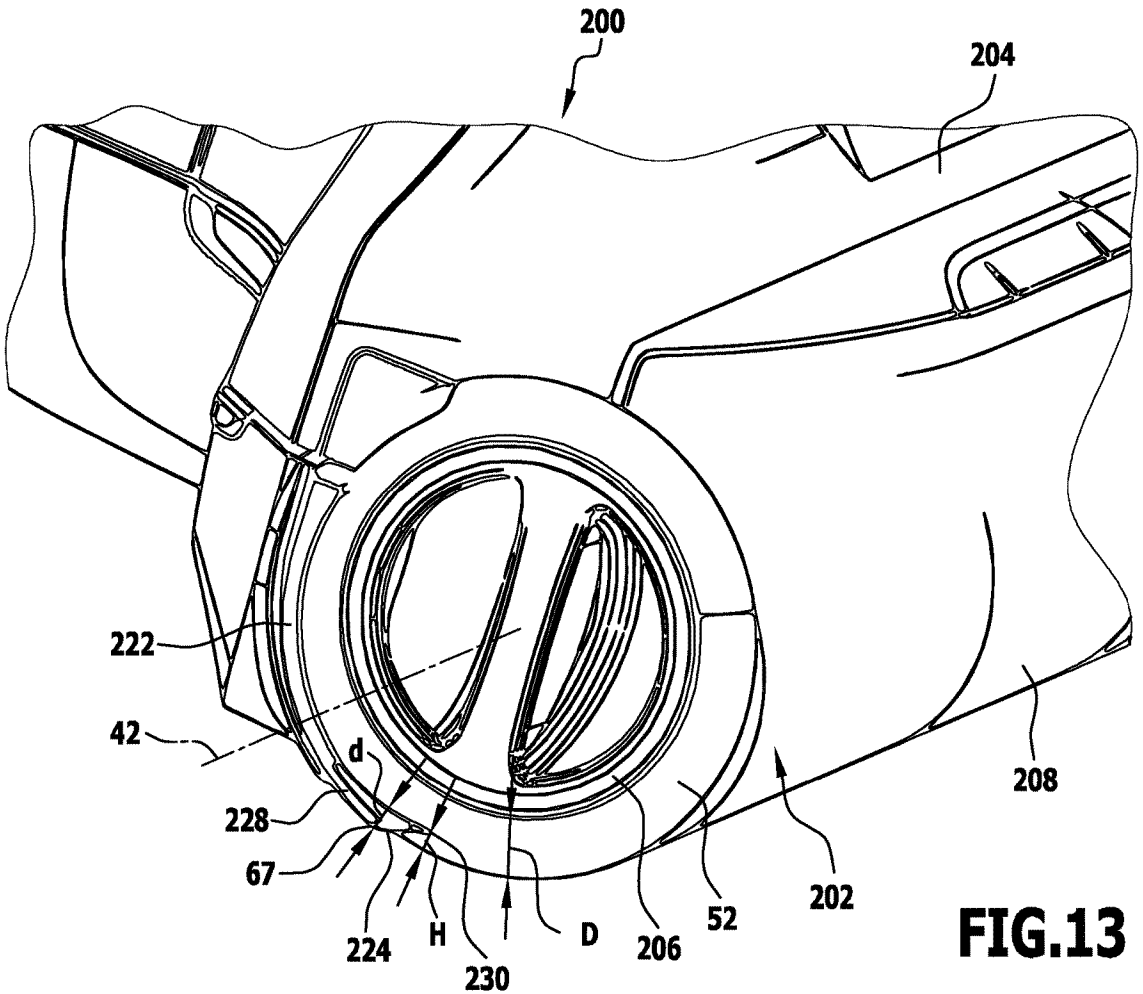
FIG. 13 shows a further perspective view of the roller region as per FIG. 12.
Figure 14:
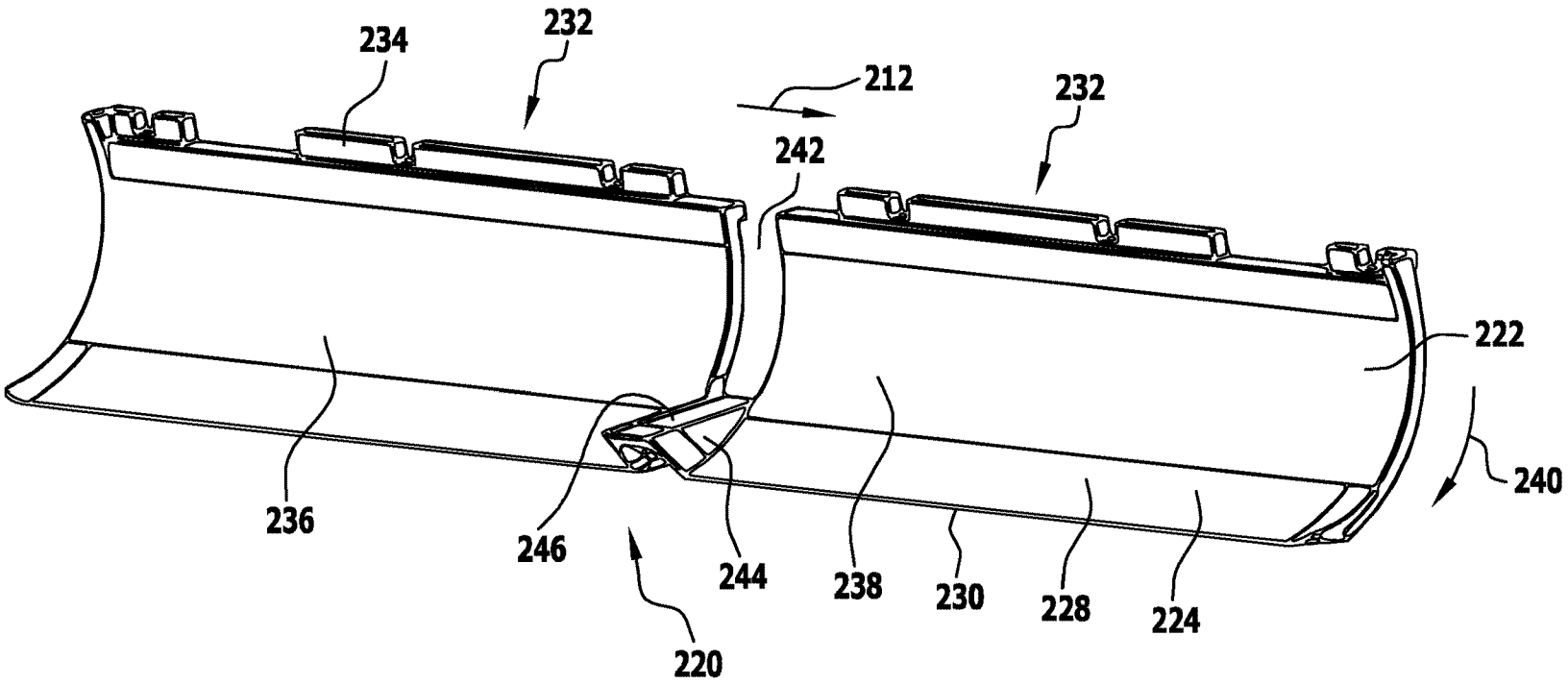
FIG. 14 is a perspective illustration of a sweeping element for the roller region as per FIGS. 12 and 13.

A fourth exemplary embodiment of a surface cleaning machine according to the invention comprises a cleaning head with a roller region which is shown in FIGS. 12 to 14 and denoted therein by 200. The parts of the surface cleaning machine outside the roller region 200 correspond to the surface cleaning machine 10.

The roller region 200 comprises a cleaning roller 202 which is basically the same design as the cleaning roller 26 described above. The cleaning roller 202 is held on a cleaning roller holder 204.

The cleaning roller 202 is held on the cleaning roller holder 204 so as to be rotatable about an axis of rotation corresponding to the axis of rotation 42. The drive device 40 is provided for driving the rotation.

In one exemplary embodiment, the cleaning roller 202 has a sleeve 206 on which there is arranged a jacket corresponding to the jacket 52. The jacket 52 is fixed, in the manner of a cylindrical shell, to the sleeve 206.

The sleeve 206 is mounted on the cleaning roller holder 204 so as to be rotatable about the axis of rotation 42 and is driven in its rotational movement by the drive device 40.

In one exemplary embodiment, the cleaning roller 202 has a first part 208 and a second part 210 with respective sleeve part of the sleeve 206. The second part 210 is merely indicated in FIG. 12.

The first part 208 and the second part 210 follow one another in a longitudinal direction 212 of the cleaning roller 202. The longitudinal direction 212 is parallel and in particular coaxial with respect to the axis of rotation 42.

In one exemplary embodiment, a shaft 213 is rotatably mounted centrally (in the middle) on the cleaning roller holder 204, wherein the mounting in the middle relates to a longitudinal direction of the cleaning roller holder 204. Said longitudinal direction of the cleaning roller holder 204 is parallel to the longitudinal direction 212 of the cleaning roller 202. The shaft 213 has a length in the longitudinal direction 212 shorter, and in particular considerably shorter, than the length of the cleaning roller holder 204 in said direction in the region of the cleaning roller 202.

The first part 208 is arranged rotationally conjointly, by means of its sleeve part, on one side of the shaft 213 in an outward direction. The second part 210 of the cleaning roller 202 is arranged rotationally conjointly, by means of its sleeve part, on the oppositely situated other side of the shaft 213.

The first part 208 and the second part 210 are each equipped with the jacket 52. A central region 214 which is situated between the first part 208 and the second part 210 has no jacket 52. The shaft 213 is positioned in said central region 214, wherein a strip-like region 216 of the shaft 213 forms, in the central region 214, an outer side of the cleaning roller 202. (On the first part 208 and on the second part 210, a corresponding outer side of the cleaning roller 202 is formed by means of a surface of the jacket 52.)

The cleaning roller holder 204 has, facing toward the cleaning roller 202, a holding region 218 for a sweeping element 220. The holding region 218 has, in particular facing toward the cleaning roller 202, a cylindrical surface.

The sweeping element 220 is of two-part form with a first part 222 and a second part 224. By means of the first part 222, the sweeping element 220 is fixed to the holding region, and is for example screwed and/or adhesively bonded thereto and/or clipped onto the cleaning roller holder 204.

The first part of the sweeping element 222 has, facing toward the cleaning roller 220, a cylindrical surface 226.

The sweeping element 220 has a front region 228. The front region 228 is formed on the second part 224. The sweeping element has, on the front region 228, a front face end 230. The front face end 230 extends substantially parallel to the axis of rotation 42 of the cleaning roller 202.

The second part 224 is connected to the first part 222. In particular, the sweeping element 220 is produced by means of a multi-component injection molding process, and here, is produced in particular by means of a two-component injection molding process.

The second part 224 has different material characteristics than the first part 222. In particular, the second part 224 and the first part 222 are produced from plastics material, wherein the material for the second part 224 has greater elasticity than the material for the first part 222.

The first part 222 is of substantially inelastic form. It is produced in particular from a fiber-reinforced, for example glass-fiber-reinforced, plastics material. Any inherent elasticity is such that it is not functional for the sweeping element 220.

The first part 222 is for example produced from a glass-fiber-reinforced polyamide plastics material.

The second part 224 preferably has a Shore hardness in the range between 70 and 90.

The second part 224 is formed such that the front region 228 is elastically movable relative to the first part 222.

The sweeping element 220 (cf. also FIG. 14) has a direction of extent parallel to the longitudinal direction 212.

In one exemplary embodiment, there is arranged on the first part 222 a fixing device 232 which has lugs 234 or the like into which corresponding counterpart elements of the cleaning roller holder 204 are insertable in order to permit fixing for example by adhesive bonding or by positive engagement.

The sweeping element 220 has a first region 236 which is associated with the first part 222 of the cleaning roller 202. It furthermore has a second region 238 which is associated with the second part 224 of the cleaning roller 202. The first part 222 and the second part 224 are formed both on the first region 236 and on the second region 238.

Both in the first region 236 and in the second region 238, the first part 222 is followed by the second part 224 in a circumferential direction 240 (in relation to the axis of rotation 42 of the cleaning roller 202), with a connecting region between the first part 222 and the second part 224.

Between the first region 236 and the second region 238, a through-recess 242 is formed so as to be associated with the central region 214. One or more coupling elements of the drive device 40 extend through the through-recess 242, which coupling elements correspondingly couple the shaft 213 in terms of torque transmission to a drive motor of the drive device 40.

The first region 236 and the second region 238 are connected to one another by a web 244. The web 244 is arranged in the region of the through-recess 242, that is to say the through-recess 242 adjoins the web 244.

In one exemplary embodiment, the web 244 has, associated with the cleaning roller 202, a sliding surface 246. The sliding surface 246 is associated with a counterpart sliding surface 248 in particular on the shaft 213. By means of the counterpart sliding surface 248, the rotating shaft 213, on which the cleaning roller 202 is seated, can slide on the sliding surface 246.

The sweeping element 220 is seated fixedly and in particular non-displaceably and non-rotatably on the cleaning roller holder 204. Elastic movability of the second part 224 relative to the first part 222 is possible, as mentioned above, wherein no longitudinal displacement and rotation of the second part 224 are possible. In particular, the second part 224 is connected integrally to the first part 222.

The second part 224 is designed such that, at least during cleaning operation, when the surface cleaning machine 10 is set down by means of the cleaning roller 202 on the surface for cleaning 46, it penetrates into the jacket 52 and in particular into the nonwoven material of the cleaning roller 202 (cf. FIG. 13).

During cleaning operation, the cleaning roller 202 has, at the jacket 52, a thickness D (FIG. 13). (When the surface cleaning machine is set down by means of the cleaning roller 202 on the surface for cleaning 46, then the jacket 52 is compressed in relation to the sleeve 206. The thickness D is normally smaller than a corresponding thickness when the cleaning roller 202 is not in a set-down state.)

During cleaning operation, the front region 228 penetrates into the jacket 52, specifically in such a way that a spacing A amounts to at least 5 percent of the thickness D, and lies in particular in the range between 5 percent and 80 percent of the thickness D.

Owing to the penetration of the front region 228 of the sweeping element 220 into the jacket 52, it is possible for continuous adaptation of the sweeping element 220 to the surface for cleaning 46 to be realized. In effect, a pile depth of the jacket 52 is utilized to realize a continuous adaptation of the sweeping element 220 to the floor.

The sweeping element 220 has a sweeping edge 67 by means of which the sweeping element 220 abuts against the surface for cleaning 46. Owing to the contact of the sweeping edge 67, "swept" dirt is fed to the cleaning roller 202 and is entrained by the latter.

The sweeping edge 67 may basically be situated at different points of the sweeping element 220 in a manner dependent on a relative position of the appliance body 12 with respect to the surface for cleaning 46.

The front face end 230 which penetrates into the jacket 52 is spaced apart from the sweeping edge 67.

The sweeping edge 67 is arranged on the second part 224. The sweeping element 220 is dimensioned such that, during intended use of the surface cleaning machine 10 with sweeping functionality, the sweeping edge 67 abuts against the second part 224 in all angular positions of the surface cleaning machine 10 relative to the surface for cleaning 46 when the cleaning roller 202 is set down on the surface for cleaning 46.

The second part 224 of the sweeping element 220 has a region which decreases in cross section (in thickness d as per FIG. 13) toward the front face end 230. In said region, the front region 228 is of wedge-shaped form in cross section.

At least during cleaning operation, the sweeping element 220 is formed such that a spacing of the front face end 230 to the axis of rotation 42 is smaller than a spacing of the first part 222 to said axis of rotation. In this way, a penetrating action is made possible.

The solution according to the invention functions as follows:

The sweeping element 220 projects with a front region 228 into the jacket 52 of the cleaning roller 202 during cleaning operation.

In an exemplary embodiment, the sweeping element 220 is in this case arranged non-displaceably and non-rotatably on the cleaning roller holder 204.

It is however also possible for a for example rotatably arranged sweeping element such as the sweeping element 66 to project with a front region into the jacket 52 of the cleaning roller 26.

During cleaning operation of the surface cleaning machine 10, said surface cleaning machine is set down by means of the cleaning roller 26 or 202 on the surface for cleaning 46. Coarse dirt is swept up by means of the sweeping element 66 or 220 and, here, is fed without centrifuging effect to the cleaning roller 26 or 202 and is entrained by the latter.

Here, it is basically the case that an angle of the appliance body 12 relative to the surface for cleaning 46 is variable.

By means of the design of the sweeping element 66 or 220, said sweeping effect can be achieved independently of the angle of use of the surface cleaning machine 10 relative to the surface for cleaning 46. Owing to the penetration of the sweeping element 66 or 220 with a front region 228 into the associated cleaning roller 26 or 202, a uniform spacing between the sweeping edge 67 and the corresponding cleaning roller 26 or 202 is achieved.

The sweeping element 220 is of elastically flexible form, wherein, in particular, the second part 224 has greater elasticity than the first part 222. As is also the case with the sweeping element 66, a corresponding force for holding the front region 228 in an inserted state can be realized by the inherent weight of the surface cleaning machine during cleaning operation when the cleaning roller 26, 202 is set down on the surface for cleaning 46.

It is then possible for coarse dirt which is fed by means of the sweeping element 66 or 220 to the cleaning roller 26 or 202 to be fed by means of the cleaning roller 26 or 202 to the corresponding suction mouth 60.

In the case of the sweeping element 220, the second part 224 can deform such that continuous adaptation to the floor is possible, that is to say such that a sweeping edge 67 is always formed.

It is basically still possible for the sweeping element 220 to be of flexible form, in particular in the first part 222, such that "bulging" rearward, that is to say away from the cleaning roller 202, is possible. It is then possible for coarse dirt to collect in a "bulge region" of said type, wherein, in particular, the region may form in the event of the surface cleaning machine 10 being lowered toward the surface for cleaning 46. When the surface cleaning machine is straightened, the collected coarse dirt can be transported away.

The movability of the second part 224 relative to the first part 222 based on inherent elasticity may for example at least approximately follow a circular path, or may also involve a pivoting movement about a defined pivot axis (hinging).

The sweeping element 220 is dimensioned such that a sweeping edge 67 can be formed in particular on the second part 224 in all angular positions of the surface cleaning machine 10 relative to the surface for cleaning 46, and at the same time the front region 228 penetrates into the jacket 52 of the cleaning roller 202.

LIST OF REFERENCE NUMERALS

10 Surface cleaning machine
12 Appliance body

14 Housing
16 Suction apparatus
18 Cleaning head
20 Separator device
22 Reservoir device
24 24 Wetting device
26 Cleaning roller
28 Reservoir device
30 Holder
32 Holding rod
34 Holding handle
36 Winding device
38 Cleaning roller holder
40 Drive device
42 Axis of rotation
44 Pivot axis
46 Surface for cleaning
47 Contact line
48 Pivot axis
50 Longitudinal axis
52 Jacket
54 Connector
56 Line
58 Connection
60 Suction mouth
62 First mouth wall
64 Second mouth wall
66 Sweeping element
67 Sweeping edge
68 Forward direction
69 Contact line
70 Clockwise
71 Axis of rotation
72 First guide device
74 Inner side
76 Second guide device
78*a, b* Guide element
80 Penetration region
82 Guide track
84 Transmission device
86 Region
88*a, b* Face side
90 Divider
92 Sliding surface
94 Sliding region (first part)
96 Contact region (second part)
97 Front face end
98 Plastic device
100 Spring force
102 Stop
103 Counterpart element
104 Clockwise
106 Angular position
108 Longitudinal axis
110 Spring device
112 End
114 End
116 First spring
118 Second spring
120 Support element
122 First housing part
124 Pivot bearing
126 Base
128 Second housing part
130 Pivot bearing
132 Duct
134 Elastic device
136 Torsion spring
138 Element
140 Interior space
142 Elastic device
144 Rubber spring
200 Roller region
202 Cleaning roller
204 Cleaning roller holder
206 Sleeve
208 First part
210 Second part
212 Longitudinal direction
213 Shaft
214 Central region
216 Strip-like region
218 Holding region
220 Sweeping element
222 First part
224 Second part
226 Cylindrical surface
228 Front region
230 Front face end
232 Fixing device
234 Lug
236 First region
238 Second region
240 Circumferential direction
242 Through-recess
244 Web
246 Sliding surface
248 Counterpart sliding surface
d Thickness of the second part 224
D Thickness of the jacket 52
H Spacing to the outer side of the jacket 52

The invention claimed is:

1. A surface cleaning machine, comprising:

a cleaning roller holder;

at least one cleaning roller which is arranged on the cleaning roller holder;

a drive device for driving the at least one cleaning roller in rotation; and a sweeping element which is associated with the at least one cleaning roller and which feeds swept material to the at least one cleaning roller;

wherein the sweeping element, at least during a cleaning operation, is in contact with a surface to be cleaned and projects with a front region into a jacket of the at least one cleaning roller; and wherein a front face end of the sweeping element is arranged on the front region.

2. The surface cleaning machine as claimed in claim 1, wherein the front region is of elastic form such that, when the surface cleaning machine is set down on a surface for cleaning by means of the at least one cleaning roller, the inherent weight of the surface cleaning machine causes said front region to project into the jacket.

3. The surface cleaning machine as claimed in claim 1, wherein, at least during cleaning operation of the surface cleaning machine, the front face end projects at a spacing to an outer side of the jacket in a range between 5 percent and 80 percent of a thickness of the jacket.

4. The surface cleaning machine as claimed in claim 1, wherein the sweeping element is formed in at least two parts with a first part and a second part, wherein the second part has greater elasticity than the first part and the front region is arranged or formed on the second part.

5. The surface cleaning machine as claimed in claim 4, wherein the first part has no elasticity that is functional for the sweeping element.

6. The surface cleaning machine as claimed in claim 4, wherein the second part has a Shore hardness in the range between 70 and 90.

7. The surface cleaning machine as claimed in claim 4, wherein the sweeping element is formed such that a sweeping edge always abuts against the second part during cleaning operation.

8. The surface cleaning machine as claimed in claim 4, wherein the second part follows the first part in a circumferential direction, and in particular the second part is connected to the first part.

9. The surface cleaning machine as claimed in claim 4, wherein the first part has a cylindrical surface facing toward the cleaning roller.

10. The surface cleaning machine as claimed in claim 1, wherein the sweeping element is produced by means of a multi-component injection molding process, and in particular a two-component injection molding process.

11. The surface cleaning machine as claimed in claim 1, wherein, in the front region or in a partial section of the front region, a thickness of the sweeping element tapers toward the front face end.

12. The surface cleaning machine as claimed in claim 1, wherein the front region is formed such that, at least during cleaning operation, a spacing between an outer side, facing toward the at least one cleaning roller, of the front region and an axis of rotation of the cleaning roller decreases, at least in a partial section, toward the front face end.

13. The surface cleaning machine as claimed in claim 1, wherein the sweeping element has a first region and a second region which follow one another along an axis of rotation of the at least one cleaning roller, wherein at least one through-recess is arranged between the first region and the second region.

14. The surface cleaning machine as claimed in claim 13, wherein the at least one cleaning roller is formed in at least two parts with a first part, which is associated with the first region of the sweeping element, and a second part, which is associated with the second region of the sweeping element, wherein one or more coupling elements of the drive device which couple the drive device to the at least one cleaning roller extend through the at least one through-recess.

15. The surface cleaning machine as claimed in claim 13, wherein the first region and the second region are connected by means of a web.

16. The surface cleaning machine as claimed in claim 15, wherein a sliding surface is formed on the web, wherein, in particular, an associated counterpart sliding surface has no jacket.

17. The surface cleaning machine as claimed in claim 1, wherein, during cleaning operation of the surface cleaning machine in which the at least one cleaning roller is set down on a surface for cleaning, the front face end projects into the jacket of the at least one cleaning roller and does not abut against the surface for cleaning, and in particular a sweeping edge which abuts against the surface for cleaning is spaced apart from the front face end.

18. The surface cleaning machine as claimed in claim 1, wherein the sweeping element is arranged fixedly on the cleaning roller holder and is arranged in particular in non-displaceable and non-rotatable manner on the cleaning roller holder.

19. The surface cleaning machine as claimed in claim 1, wherein the sweeping element is arranged in movable manner on the cleaning roller holder.

20. The surface cleaning machine as claimed in claim 1, comprising a suction device with a suction apparatus and at least one suction mouth which is fluidically connected to the suction apparatus and which is directed toward the at least one cleaning roller for removing fluid by suction from the at least one cleaning roller.

21. The surface cleaning machine as claimed in claim 20, wherein, during cleaning operation, the sweeping element is positioned between a surface for cleaning, onto which the at least one cleaning roller is set down, and the at least one suction mouth.

22. The surface cleaning machine as claimed in claim 1, wherein, during cleaning operation, the surface cleaning machine is set down or supported on a surface for cleaning exclusively by means of the at least one cleaning roller, and in particular a single cleaning roller.

23. The surface cleaning machine as claimed in claim 1, wherein, during cleaning operation with the surface cleaning machine being pushed forward, a direction of rotation of the at least one cleaning roller is clockwise.

24. The surface cleaning machine as claimed in claim 1, wherein, in the case of the surface cleaning machine with at least one cleaning roller set down on a surface for cleaning being pushed in a forward direction, the sweeping element, facing away from the forward direction, covers the at least one cleaning roller in the rearward direction, and lies against the surface for cleaning at least over a length of the at least one cleaning roller.

25. The surface cleaning machine as claimed in claim 1, comprising a wetting device for the at least one cleaning roller.

* * * * *